US008821195B2

(12) United States Patent
Ao et al.

(10) Patent No.: US 8,821,195 B2
(45) Date of Patent: Sep. 2, 2014

(54) CONNECTOR

(71) Applicant: Hosiden Corporation, Yao (JP)

(72) Inventors: Hitoshi Ao, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 55 days.

(21) Appl. No.: 13/731,300

(22) Filed: Dec. 31, 2012

(65) Prior Publication Data

US 2013/0178115 A1 Jul. 11, 2013

(30) Foreign Application Priority Data

Jan. 6, 2012 (JP) ..... 2012-001594

(51) Int. Cl.
*H01R 33/00* (2006.01)

(52) U.S. Cl.
USPC ..... 439/682

(58) Field of Classification Search
USPC ..... 439/682, 79, 106, 206, 637–638, 295, 439/218, 246
See application file for complete search history.

(56) References Cited

U.S. PATENT DOCUMENTS

| | | | | |
|---|---|---|---|---|
| 6,394,818 | B1 * | 5/2002 | Smalley, Jr. | 439/79 |
| 7,065,871 | B2 * | 6/2006 | Minich et al. | 29/882 |
| 7,425,145 | B2 * | 9/2008 | Ngo | 439/290 |
| 7,476,108 | B2 * | 1/2009 | Swain et al. | 439/79 |
| 7,726,982 | B2 * | 6/2010 | Ngo | 439/79 |
| 2010/0184339 | A1 * | 7/2010 | Ngo et al. | 439/682 |

FOREIGN PATENT DOCUMENTS

JP 2011-138775 A1 7/2011

* cited by examiner

*Primary Examiner* — Jean F Duverne
(74) *Attorney, Agent, or Firm* — Kratz, Quintos & Hanson, LLP

(57) ABSTRACT

The invention provides a connector including first and second contacts having substantially the same overall length. The first and second contacts each include a contact portion, a first straight portion extending in a first direction, a first bent portion bent in a direction including a second direction, an intermediate portion, a second bent portion bent in a direction including a third direction, a second straight portion extending in the direction including the third direction, and a tail. In the second contact, the contact portion is spaced apart in the third direction from the contact portion of the first contact, the first straight portion has a larger length than the first straight portion of the first contact, the second straight portion has a smaller length than the second straight portion of the first contact, and the tail is spaced apart in the first direction from the tail of the first contact.

14 Claims, 14 Drawing Sheets

CONNECTOR

The present application claims priority under 35 U.S.C. §119 of Japanese Patent Application No. 2012-001594 filed on Jan. 6, 2012, the disclosure of which is expressly incorporated by reference herein in its entity.

BACKGROUND OF THE INVENTION

1. Technical Field

The invention relates to connectors.

2. Background Art

Japanese Unexamined Patent Publication No. 2011-138775 discloses a connector having generally L-shaped first and second contacts that constitute a differential pair. The first and second contacts each include a contact portion, a first straight portion continuous with the contact portion, a second straight portion being continuous with the first straight portion and extending in a direction orthogonal to the first straight portion, and a tail continuous with the second straight portion. The first straight portion of the second contact has a larger length than the first straight portion of the first contact. A bent portion is provided in the middle of the first straight portion of the second contact to avoid interference with the second straight portion of the first contact. The second straight portion of the first contact has a larger length than the second straight portion of the second contact by the difference in length between the first straight portion of the second contact and the first straight portion of the first contact. With such a configuration, the overall length of the first contact is substantially the same as the overall length of the second contact, preventing occurrence of skew between the first and second contacts.

SUMMARY OF INVENTION

A drawback of the above conventional connector is significant difference in shape between the first and second contacts because the first straight portion of the second contact and the second straight portion of the first contact cross each other in a three-dimensional manner. It is therefore difficult to press-mold the first and second contacts at a time, requiring a plurality of press-molding dies. This causes increased costs of the connector.

The invention has been made in consideration of the above circumstances. The invention provides a connector capable of reducing the occurrence of skew between the first and second contacts and being manufactured with reduced costs.

A connector according to an aspect of the invention includes a body of insulation and first and second contacts being adapted to be held in the body and having substantially the same overall length. The first contact includes a contact portion; a first straight portion being continuous with the contact portion and extending in a first direction; a first bent portion being continuous with the first straight portion and bent in a direction including a component of a second direction, the second direction being orthogonal to the first direction; an intermediate portion being continuous with the first bent portion; a second bent portion being continuous with the intermediate portion and bent in a direction including a component of a third direction, the third direction being orthogonal to the first and second directions; a second straight portion being continuous with the second bent portion and extending in the direction including the component of the third direction; and a tail being continuous with the second straight portion. The second contact includes a contact portion being spaced apart in the third direction from the contact portion of the first contact; a first straight portion being continuous with the contact portion of the second contact, extending in the first direction, and having a larger length than the first straight portion of the first contact; a first bent portion being continuous with the first straight portion of the second contact and bent in the same direction as the bending direction of the first bent portion of the first contact; an intermediate portion being continuous with the first bent portion of the second contact; a second bent portion being continuous with the intermediate portion of the second contact and bent in the same direction as the bending direction of the second bent portion of the first contact; a second straight portion being continuous with the second bent portion of the second contact, extending along the second straight portion of the first contact, and having a smaller length than the second straight portion of the first contact; and a tail being continuous with the second straight portion of the second contact and being spaced apart in the first direction from the tail of the first contact.

In this aspect of the invention, the respective portions of the first and second contacts are configured such that the contact portions are spaced apart in the third direction from each other, and the first straight portions extend in the first direction; the first bent portions are bent in the direction including a component of the second direction, and the second bent portions are bent in the direction including a component of the third direction; the intermediate portions are each disposed between the first and second bent portions; the second straight portions extend in the direction including the component of the third direction, and the tails are spaced apart from each other in the first direction; and the first straight portion of the second contact has a larger length than that of the first contact, and the second straight portion of the second contact has a smaller length than that of the first contact. In short, the first and second contacts are arranged substantially in parallel to each other throughout their lengths, which leads to reduced occurrence of skew between the first and second contacts. Further, the first and second contacts, shaped substantially in parallel to each other throughout their lengths, can be manufactured at a time by press-molding. This contributes to reduction in number of dies for manufacturing the first and second contacts, resulting in reduced costs of the connector. Still further, the first and second contacts, arranged substantially in parallel to each other throughout their lengths, are advantageously easy to adjust impedances between them.

The first and second bent portions of the first and second contacts may be smoothly bent.

The length of the second straight portion of the second contact may be smaller than the length of the second straight portion of the first contact by substantially the same amount as the difference in length between the first straight portion of the first contact and the first straight portion of the second contact.

The connector may further include a third contact held in the body. The third contact may be disposed in spaced relation to the first straight portions of the first and second contacts in the second direction or a direction opposite to the second direction so as to extend substantially in parallel to the first straight portions of the first and second contacts.

In this aspect of the invention, the third contacts can function as a ground contact or a pseudo ground contact for the first and second contacts. Therefore, this aspect of the invention further contributes to matched impedances between the first and second contacts.

The third contact may be disposed in a region defined between the first straight portions of the first and second contacts and the second straight portions of the first and second contacts.

In this aspect of the invention, the third contact contributes to reduction in cross talk that may occur between the first straight portions of the first and second contacts and the second straight portions of the first and second contacts. Further, as the region to dispose the third contact is otherwise unused space in the connector, the addition of the third contact does not cause increase in dimension of the connector in the second direction.

The third contact may include a contact portion; a straight portion being continuous with the contact portion of the third contact, extending in the first direction, and spaced apart in the second direction from the first straight portions of the first and second contacts; an inclined portion being continuous with the straight portion and obliquely inclined with respect to the straight portion, the inclined portions being disposed between the first straight portions of the first and second contacts and the second straight portions of the first and second contacts; and a tail being continuous with the inclined portion.

In this aspect of the invention, the third contact is situated in such a manner as to reduce cross talk between the first straight portions of the first and second contacts and the second straight portions of the first and second contacts. Moreover, as the straight portion of the third contact is spaced apart in the second direction from the first straight portions of the first and second contacts, the third contact can function as a ground contact or a pseudo ground contact for the first and second contacts. Therefore, this aspect of the invention contributes to matched impedances between the first and second contacts.

The inclined portion of the third contact may extend substantially in parallel to the intermediate portions of the first and second contacts.

The first and second contacts tend to have higher impedances in their first and second bent portions and intermediate portions than in their first and second straight portions. However, the above-mentioned aspect of the invention can reduce impedances in the first and second bent portions and the intermediate portion because the inclined portion of the third contact is disposed substantially in parallel to the intermediate portions of the first and second contacts. Therefore, this aspect of the invention also contributes to matched impedances between the first and second contacts.

The body may include a first body for holding the contact portions and the first straight portions of the first and second contacts; and a second body for holding the second straight portions of the first and second contacts. This aspect of the invention makes it possible to bend the first and second bent portions of the first and second contacts in the state where the first body holds the contact portions and the first straight portions of the first and second contacts, while the second body holds the second straight portions of the first and second contacts. It is therefore possible to minimize variations in shape and/or disposition of the first and second contacts.

Alternatively, the body may include the body includes a first body for holding the contact portions and the first straight portions of the first and second contacts; a second body for holding the second straight portions of the first and second contacts; and a third body for holding the inclined portion of the third contact, the third body being disposed between the first and second bodies.

In this aspect of the invention, when the first and second bent portions of the first and second contacts are bent in the state where the first body holds the contact portions and the first straight portions of the first and second contacts and the second body holds the second straight portions of the first and second contacts, the third body holding the inclined portion of the third contact is disposed between the first and second bodies. This aspect of the invention thus eases assembly of the connector. Further, it is possible to bend the first and second bent portions of the first and second contacts in the state where the first body holds the contact portions and the first straight portions of the first and second contacts and the second body holds the second straight portions of the first and second contacts. It is therefore possible to minimize variations in shape and/or disposition of the first and second contacts.

The connector may further include a shell with electrical conductivity for surrounding the body. The intermediate portions of the first and second contacts may be exposed from the body. The shell may include an impedance adjusting portion to be disposed in the vicinity of the intermediate portions of the first and second contacts.

In this aspect of the invention, as the impedance adjusting portion is disposed in the vicinity of the intermediate portions of the first and second contacts, it is possible to reduce the impedances of the impedance of the first and second bent portions and the intermediate portions. Therefore, this aspect of the invention also contributes to matched impedances between the first and second contacts.

Alternatively, the connector may further include a shell with electrical conductivity for surrounding the body and a dielectric member. The dielectric member may be disposed between the intermediate portions exposed from the bodies of the first and second contacts and the shell.

In this aspect of the invention, the dielectric, disposed between the intermediate portions exposed from the bodies of the first and second contacts and the shell, can reduce the impedances of the first and second bent portions and the intermediate portions. Therefore, this aspect of the invention also contributes to matched impedances between the first and second contacts.

The connector may further include first and second differential pairs and a fourth contact. Each of the differential pairs may include the first and second contacts arranged in spaced relation in the third direction. The fourth contact may be disposed between the first and second differential pairs. The third contact may include a plurality of the third contacts. The third contacts may be arranged in the above-described region in such a manner that the straight portions thereof are located between the first straight portions of the first and second contacts of the first differential pair, between the first straight portions of the first and second contacts of the second differential pair, between the first straight portion of the second contact of the first differential pair and the fourth contact, and between the first straight portion of the first contact of the second differential pair and the fourth contact.

The contact portions and the first straight portions of the first and second contacts may be fixed to the body. The inclined portions of the third contacts may be fixed to the body. The straight portions of the third contacts may be elastically deformable toward the first straight portions of the first and second contacts.

The first bent portions of the first and second contacts may be bent in a direction including components of the first, second, and third directions. The intermediate portions of the first and second contacts may extend in the direction including components of the first, second, and third directions.

DESCRIPTION OF EMBODIMENTS

A connector in accordance with a first embodiment of the invention will be described below with reference to FIG. 1A to FIG. 6C.

First Preferred Embodiment

The connector shown in FIG. 1A to FIG. 1D is a receptacle connector that is mountable on a circuit board (not shown). The connector includes a body 100, first and second contact groups 200*a*, 200*b*, and a shell 300. Each constituent of the connector will be described in detail below. In FIG. 1A to FIG. 2B, a width direction of the connector is represented as X and −X directions, a depth direction of the connector is represented as Y and −Y directions, and a height direction the connector is represented as Z and −Z directions. The Y and −Y directions are orthogonal to the X and −X directions, and the Z and −Z directions are orthogonal to the Y and −Y directions and the X and −X directions. The Y, X, −X, and −Z directions corresponds to a first direction, a second direction, the direction opposite to the second direction, a third direction, respectively, that are introduced in the Claims.

Figure 2A:
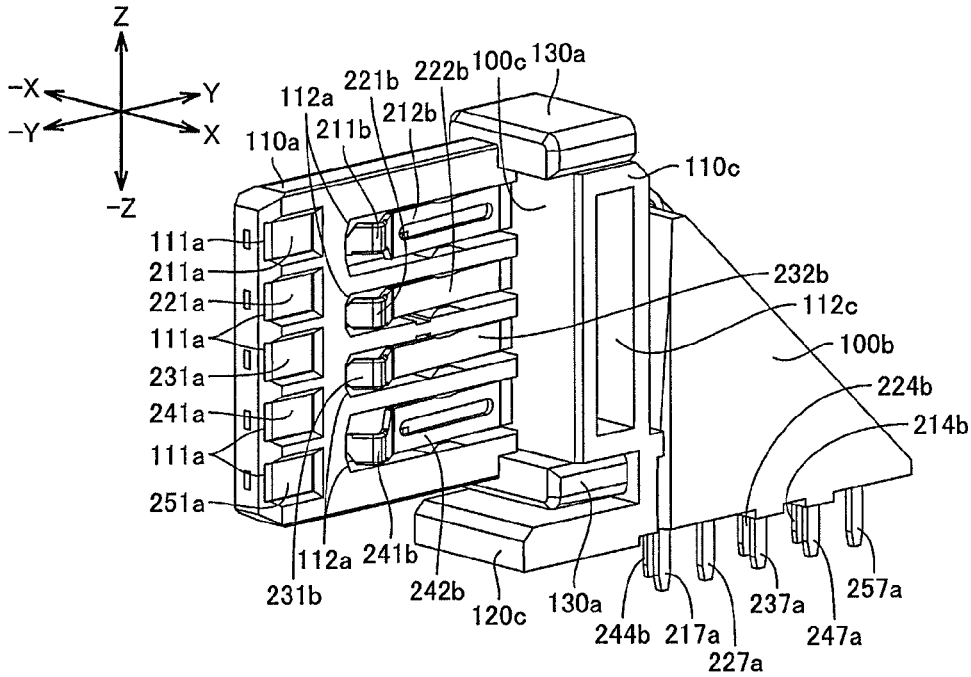
FIG. 2A is a schematic perspective view showing the front, top, and right side of the first, second, and third bodies and first and second contact groups of the connector.
Figure 2B:
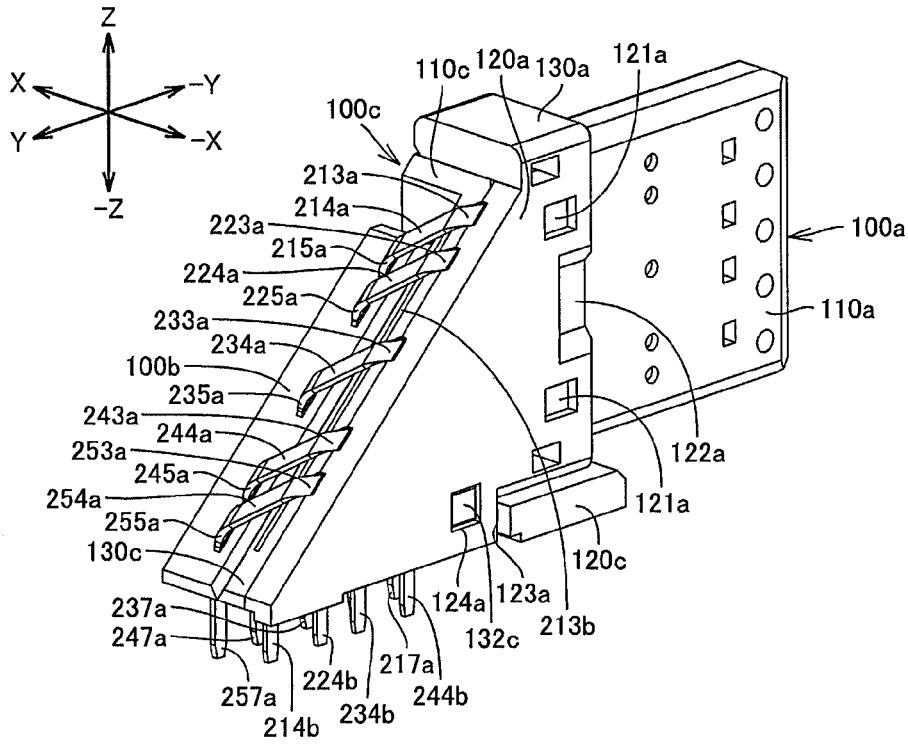
FIG. 2B is a schematic perspective view showing the back, top, and left side of the first, second, and third bodies and the first and second contact groups of the connector.

As shown in FIG. 2A and FIG. 2B, the body 100 has first, second and third bodies 100*a*, 100*b* and 100*c*, which are made of insulating resin.

Figure 3A:
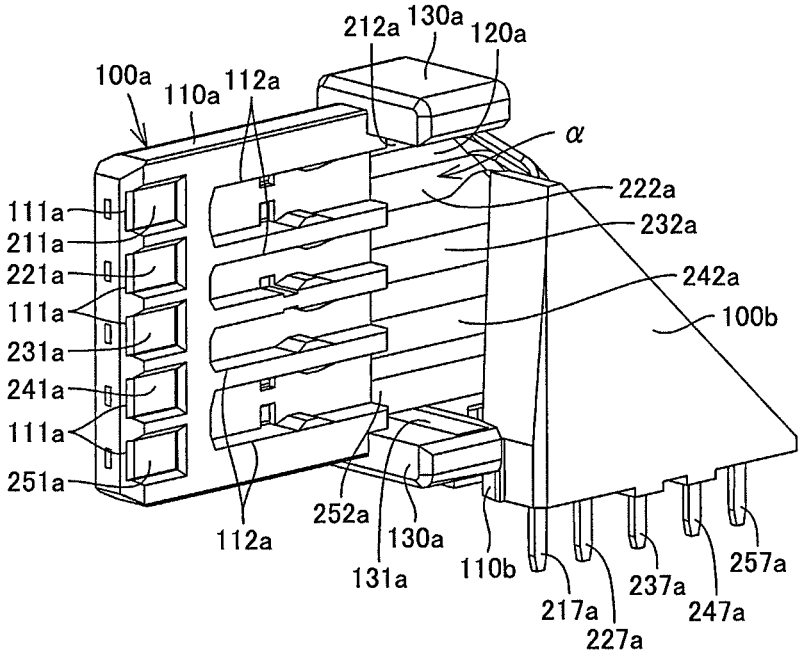
FIG. 3A is a schematic perspective view showing the front, top, and right side of the first and second bodies and the first contact group of the connector.
Figure 3B:
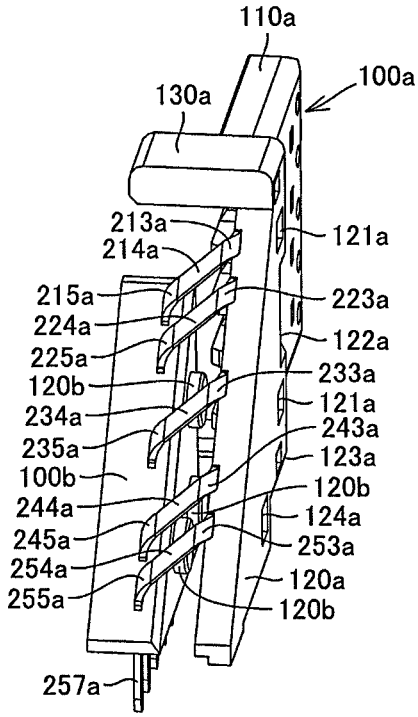
FIG. 3B is a schematic perspective view showing the back, top, and left side of the first and second bodies and the first contact group of the connector.

As shown in FIG. 3A and FIG. 3B, the first body 100*a* has a distal portion 110*a*, a proximal portion 120*a*, and a pair of arms 130*a*. The distal portion 110*a* is a generally rectangular plate. Five recesses 111*a* and four grooves 112*a* are provided in the surface in the X direction of the distal portion 110*a*. The recesses 111*a* are rectangular recesses opening in the −Y direction and are spaced apart from each other in the Z and −Z directions. The grooves 112*a* are long grooves extending in the Y and −Y directions. Each of the grooves is disposed between adjacent two recesses 111*a* and further in the Y direction.

The proximal portion 120*a* is a plate of generally right-angled triangle shape, provided continuously with the Y direction end of the distal portion 110*a*. The proximal portion 120*a* is smaller in the X and −X directions than the distal portion 110*a*. As shown in FIG. 2B, the −X direction face of the proximal portion 120*a* is provided with a pair of locking holes 121*a* and an locking recess 122*a*. The locking holes 121*a* are rectangular holes. The locking recess 122*a* is an elongated recess extending in the Z and −Z directions and being located between the locking holes 121*a*. The −Z direction end of the proximal portion 120*a* has a rectangular notch 123*a*. On the Y direction side of the notch 123*a*, there is a rectangular fitting hole 124*a* passing from the X direction face to the −X direction face of the proximal portion 120*a*. The hypotenuse side of the proximal portion 120*a* has a sloped face.

As shown in FIG. 3A, the arms 130*a* are of rectangular parallelepiped shape and extend in the X direction so as to be opposed to each other. One of the arms 130*a* is continuous with the Z direction end of the proximal portion 120*a*, and the other arm 130*a* is continuous with an edge of the notch 123*a* of the proximal portion 120*a*. The opposed surfaces of the arms 130*a* each have an locking hole 131*a* (one of the holes is shown). The Y direction end of the distal portion 110*a*, the proximal portion 120*a*, and the arms 130*a* define an accommodation space a.

The second body 100*b* is a plate generally of right-angled triangle shape. As shown in FIG. 3A, a lower end (the −Z direction end) of the −Y direction face of the second body 100*b* is provided with a locking protrusion 110*b*. As shown in FIG. 3B, the −X direction face of the second body 100*b* has three cylindrical fitting protrusions 120*b*. The hypotenuse side of the second body 100*b* has a sloped face.

The first contact group 200*a* as shown in FIG. 5A to FIG. 5E may be compliant with USB 3.0 standard. The first contact group 200*a* consists of first and second contacts 210*a*, 220*a*, a fourth contact 230*a*, and first and second contacts 240*a*, 250*a*, each contact being formed of an electrically conductive metal plate. The first and second contacts 210*a*, 220*a* are TX+, TX− signal contacts constituting a first differential pair, and they are disposed adjacent to each other. The first and second contacts 210*a*, 220*a* are of substantially the same overall length. The first and second contacts 240*a*, 250*a* are RX+, RX− signal contacts constituting a second differential pair, and they are disposed adjacent to each other. The first and second contacts 240*a*, 250*a* are of substantially the same overall length. The fourth contact is a ground contact disposed between the first and second differential pairs (i.e. between the second contact 220*a* and the first contact 240*a*).

The first contact 210*a* has a contact portion 211*a*, a first straight portion 212*a*, a first bent portion 213*a*, an intermediate portion 214*a*, a second bent portion 215*a*, a second straight portion 216*a*, and a tail 217*a*. The second contact 220*a* has a contact portion 221*a*, a first straight portion 222*a*, a first bent portion 223*a*, an intermediate portion 224*a*, a second bent portion 225*a*, a second straight portion 226*a*, and a tail 227*a*. The fourth contact 230*a* has a contact portion 231*a*, a first straight portion 232*a*, a first bent portion 233*a*, an intermediate portion 234*a*, a second bent portion 235*a*, a second straight portion 236*a*, and a tail 237*a*. The first contact 240*a* has a contact portion 241*a*, a first straight portion 242*a*, a first bent portion 243*a*, an intermediate portion 244*a*, a second bent portion 245*a*, a second straight portion 246*a*, and a tail 247*a*. The second contact 250*a* has a contact portion 251*a*, a first straight portion 252*a*, a first bent portion 253*a*, an intermediate portion 254*a*, a second bent portion 255*a*, a second straight portion 256*a*, and a tail 257*a*.

As shown in FIG. 3A, the contact portions 211*a*, 221*a*, 231*a*, 241*a*, 251*a* are generally rectangular plates. They are embedded (fixed) in the distal portion 110*a* of the first body 100*a*, arrayed in this order at spaced intervals along the −Z direction, and exposed from the respective recesses 111*a* of the distal portion 110*a*.

The first straight portions 212*a*, 222*a*, 232*a*, 242*a*, 252*a* are long plates extending in the Y direction, provided continuously with the contact portions 211*a*, 221*a*, 231*a*, 241*a*, 251*a*, respectively. The first straight portion 222*a* has a larger length than the first straight portion 212*a*. The first straight portion 232*a* has a larger length than the first straight portion 222*a*. The first straight portion 242*a* has a larger length than the first straight portion 232*a*. The first straight portion 252*a* has a larger length than the first straight portion 242*a*. The first straight portions 212*a*, 222*a*, 232*a*, 242*a*, 252*a* are embedded (fixed) in the distal portion 110*a* and the proximal portion 120*a* of the first body 100*a*. As shown in FIG. 3A, the X direction faces of the first straight portions 212*a*, 222*a*, 232*a*, 242*a*, 252*a* are exposed from the X direction faces of the proximal portion 120*a*. The X direction faces of the first straight portions 212*a*, 222*a*, 232*a*, 242*a*, 252*a* are flush with the X direction face of the proximal portion 120*a*.

The first bent portions 213*a*, 223*a*, 233*a*, 243*a*, 253*a* are continuous with the first straight portions 212*a*, 222*a*, 232*a*, 242*a*, 252*a*, respectively, and they are all bent in a direction including components of X, Y, and −Z directions (i.e. a direction including components of the first, second, and third directions). The first bent portions 213*a*, 223*a*, 233*a*, 243*a*, 253*a* protrude in the Y direction from the sloped face of the proximal portion 120*a* (the sloped face of the first body 100*a*).

The intermediate portions 214*a*, 224*a*, 234*a*, 244*a*, 254*a* are straight plates continuous with the first bent portions 213*a*, 223*a*, 233*a*, 243*a*, 253*a*, respectively, and they all extend in the direction including components of the X, Y, and −Z directions (i.e. the direction including components of the first, second, and third directions). The second bent portions 215*a*, 225*a*, 235*a*, 245*a*, 255*a* are continuous with the intermediate portions 214*a*, 224*a*, 234*a*, 244*a*, 254*a*, respectively, and they are all bent in the −Z direction.

The second straight portions 216*a*, 226*a*, 236*a*, 246*a*, 256*a* are long plates continuous with the second bent portion 215*a*, 225*a*, 235*a*, 245*a*, 255*a*, respectively, and they all extend in the −Z direction. The second straight portion 226*a* has a smaller length than the second straight portion 216*a* by substantially the same amount as the difference in length between the first straight portion 222*a* and the first straight portion 212*a*. The second straight portion 236*a* has a smaller length than the second straight portion 226*a* by substantially the same amount as the difference in length between the first straight portion 232*a* and the first straight portion 222*a*. The second straight portion 246*a* has a smaller length than the second straight portion 236*a* by substantially the same amount as the difference in length between the first straight portion 242*a* and the first straight portion 232*a*. The second straight portion 256*a* has a smaller length than the second straight portion 246*a* by substantially the same amount as the difference in length between the first straight portion 252*a* and the first straight portion 242*a*. The second straight portions 216*a*, 226*a*, 236*a*, 246*a*, 256*a* are embedded in and extend through the second body 100*b*, more particularly, extending from the sloped face to the −Z direction face of the second body 100*b*. The second bent portion 215*a*, 225*a*, 235*a*, 245*a*, 255*a* protrude in the Y direction from the sloped face of the second body 100*b*. That is, the first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a* are located outside the first and second bodies 100*a*, 100*b*.

The first straight portions 212*a*, 222*a*, 232*a*, 242*a*, 252*a* are partially opposed to the second straight portions 216*a*, 226*a*, 236*a*, 246*a*, 256*a*, respectively. As shown in FIG. 3A and FIG. 3B, the second body 100*b* with the second straight portions 216*a*, 226*a*, 236*a*, 246*a*, 256*a* embedded therein is opposed to the proximal portion 120*a* of the first body 100*a*. The region defined between the first and second bodies 100*a*, 100*b* (i.e., the region between the first straight portions 212*a*, 222*a*, 232*a*, 242*a*, 252*a* and the second straight portions 216*a*, 226*a*, 236*a*, 246*a*, 256*a*) will be used for disposing the second contact group 200*b*.

The tails 217*a*, 227*a*, 237*a*, 247*a*, 257*a* are plates continuous with the second straight portions 216*a*, 226*a*, 236*a*, 246*a*, 256*a*, respectively, and they all extend in the −Z direction. The tails 217*a*, 227*a*, 237*a*, 247*a*, 257*a* are arrayed in this order at spaced intervals in a row along the Y direction. The tails 217*a*, 227*a*, 237*a*, 247*a*, 257*a* are connectable to respective first through hole electrodes in the circuit board.

The first and second contacts 210*a*, 220*a* are arranged such that an equal distance is maintained between the first straight portions 212*a*, 222*a*, between the first bent portions 213*a*, 223*a*, between the intermediate portions 214*a*, 224*a*, between the second bent portions 215*a*, 225*a*, and between the second straight portions 216*a*, 226*a*. Similarly, the first and second contacts 240*a*, 250*a* are arranged such that an equal distance is maintained between the first straight portions 242*a*, 252*a*, between the first bent portions 243*a*, 253*a*, between the intermediate portions 244*a*, 254*a*, between the second bent portions 245*a*, 255*a*, and between the second straight portions 246*a*, 256*a*.

Figure 4A:
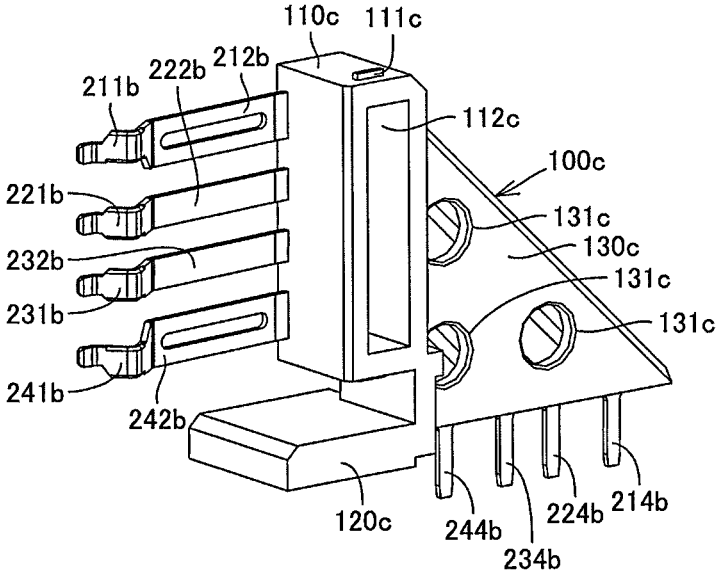
FIG. 4A is a schematic perspective view showing the front, top, and right side of the third body and the second contact group of the connector.
Figure 4B:
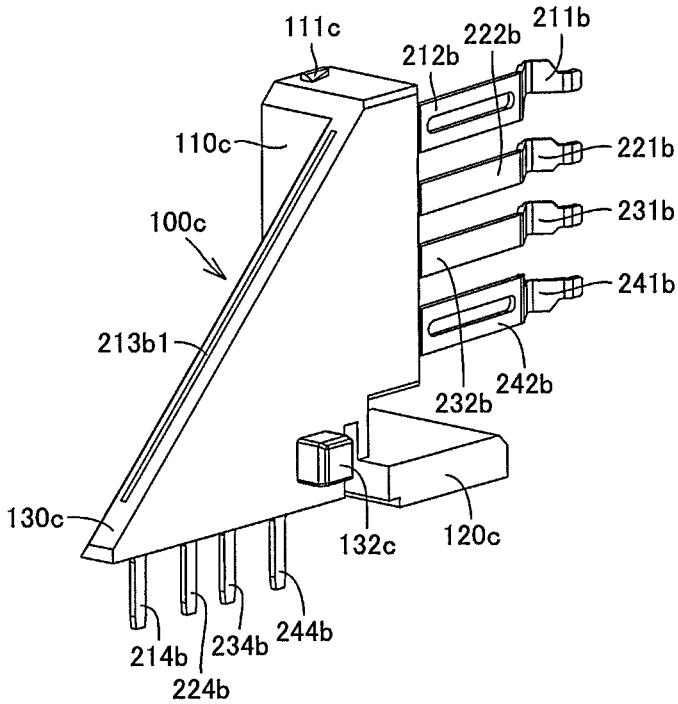
FIG. 4B is a schematic perspective view showing the back, top, and left side of the third body and the second contact group of the connector.

As shown in FIG. 4A and FIG. 4B, the third body 100*c* includes a block 110*c*, a tongue 120*c*, and a plate 130*c*. The plate 130*c* is a plate generally of right-angled triangle shape, provided continuous with the block 110*c* and the tongue 120*c*. The plate 130*c* has a substantially equal dimension in the X and −X directions to the distance between the proximal portion 120*a* of the first body 100*a* and the second body 100*b*. The plate 130*c* is securely held between the proximal portion 120*a* of the first body 100*a* and the second body 100*b*. The X direction face of the plate 130*c* has fitting recesses 131*c* at positions corresponding to the fitting protrusions 120*b* of the second body 100*b*. The −X direction face of the plate 130*c* has a rectangular fitting protrusion 132*c*. When the plate 130*c* is held between the proximal portion 120*a* of the first body 100*a* and the second body 100*b*, the fitting protrusions 120*b* are fittingly engaged in the fitting recesses 131*c*, and the fitting protrusion 132*c* is fittingly engaged in the fitting hole 124*a* of the first body 100*a*. The hypotenuse side of the plate 130*c* has a sloped face.

Figure 1A:
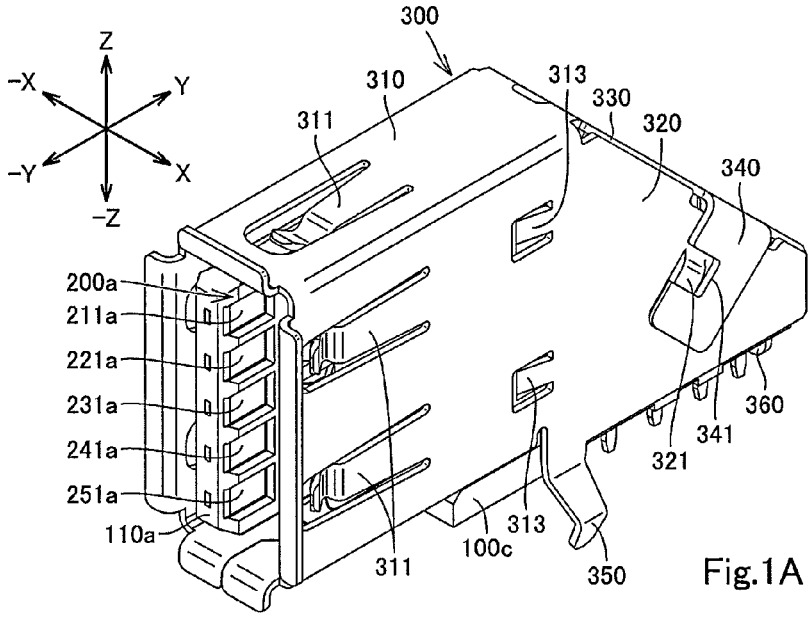
FIG. 1A is a schematic perspective view showing the front, top, and right side of a connector in accordance with a first embodiment of the invention.
Figure 1B:
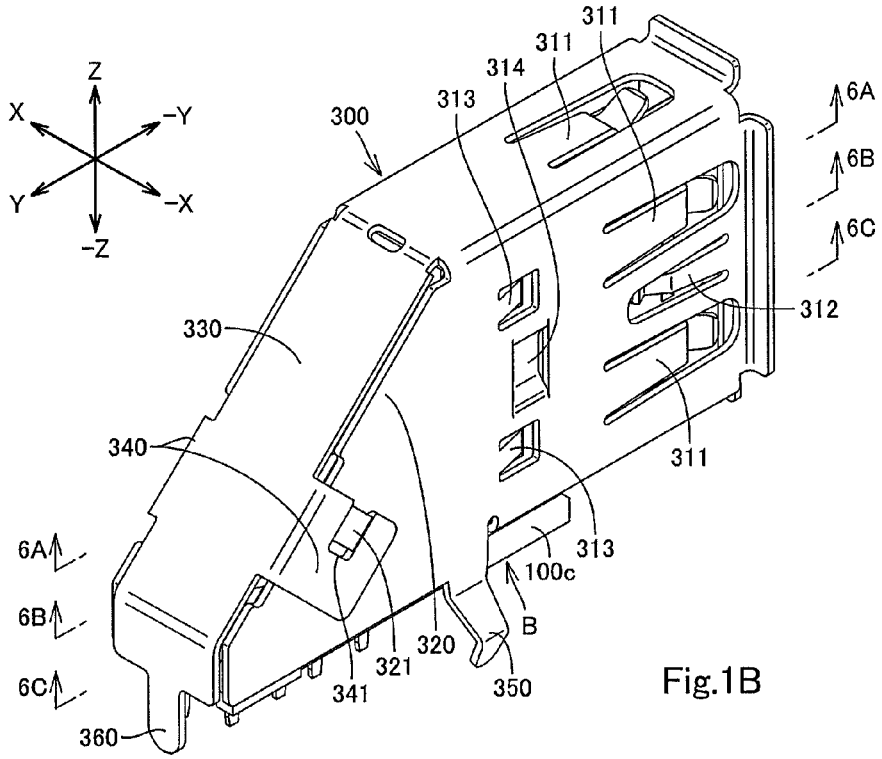
FIG. 1B is a schematic perspective view showing the back, top, and left side of the connector.
Figure 1C:
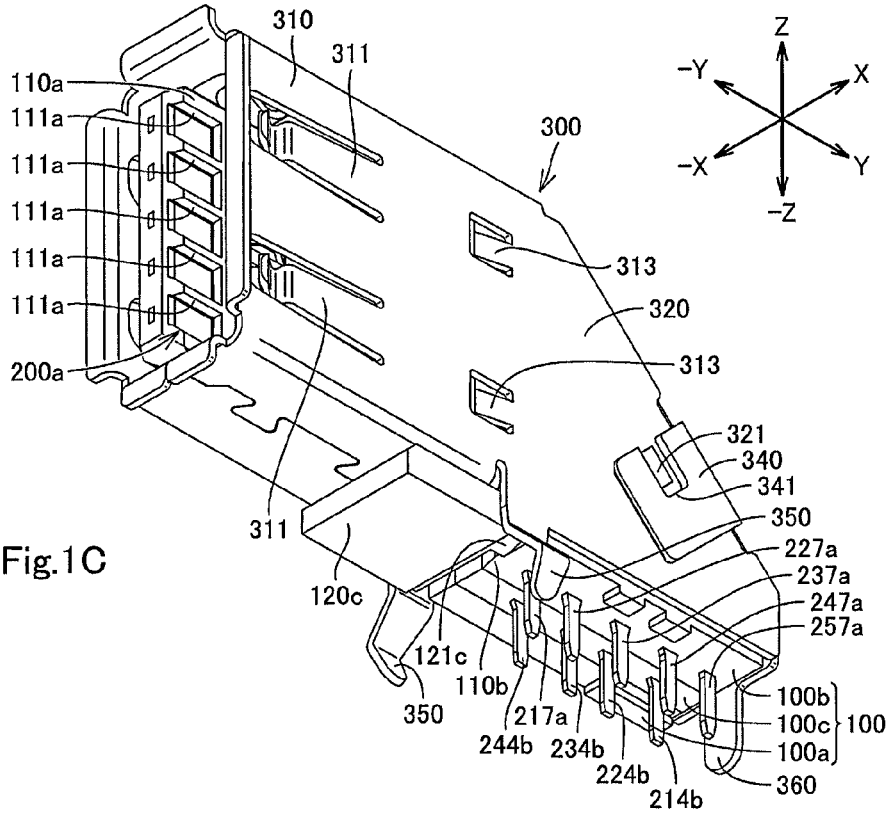
FIG. 1C is a schematic perspective view showing the front, bottom, and right side of the connector.
Figure 1D:
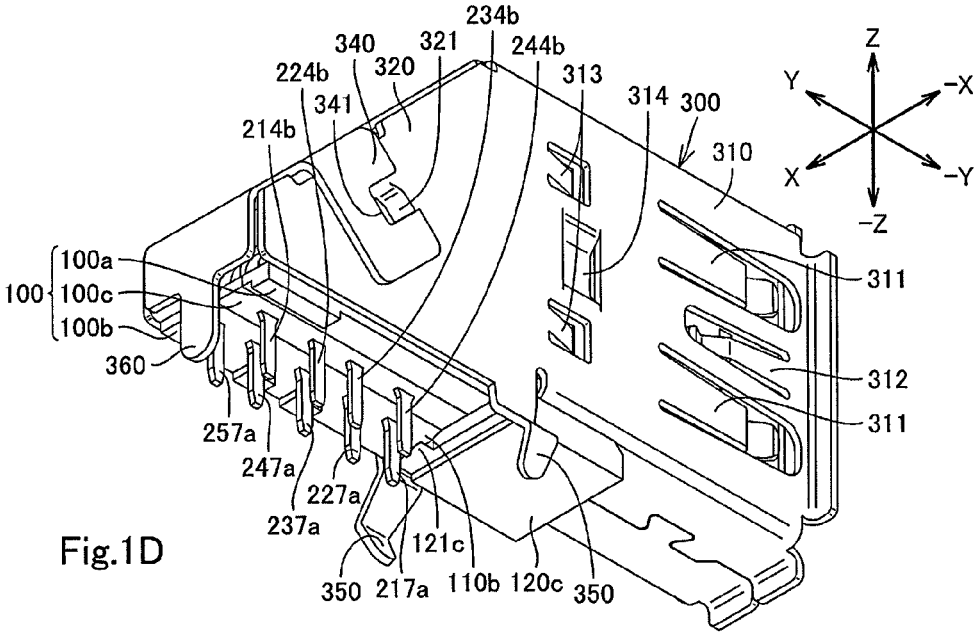
FIG. 1D is a schematic perspective view showing the back, bottom, and left side of the connector.

The block 110*c* is a rectangular parallelepiped extending in the Z and −Z directions. The dimension in the Z and −Z directions of the block 110*c* is substantially equal to the distance between the arms 130*a* of the first body 100*a*. The block 110*c* fits in the accommodation space a of the first body 100*a*. The ends in the Z and −Z directions of the block 110*c* are provided with locking claws 111*c* (one of the claws is shown). The locking claws 111*c* are engaged with the locking holes 131*a* of the arms 130*a* of the first body 100*a*. The X direction face of the block 110*c* has a rectangular locking hole 112*c*. The tongue 120*c* is a generally L-shaped plate continuous with the −Z direction end of the block 110*c*. The L-shaped tongue 120*c* has a first portion on the Z direction side and a second portion on the −Z direction side oriented orthogonal to the first portion. The distance between the second portion of the tongue 120*c* and the block 110*c* is larger than the dimension in the Z and −Z directions of the arm 130*a* on the −Z direction side of the first body 100*a*. As shown in FIG. 2A, this arm 130*a* is disposed between the second portion of the tongue 120*c* and the block 110*c*, leaving a gap between the second portion of the tongue 120*c* and the arm 130*a*. The Y direction face of the second portion of the tongue 120*c* has an locking protrusion 121*c* as shown in FIG. 1D. When the plate 130*c* is held between the proximal portion 120*a* of the first body 100*a* and the second body 100*b*, the locking protrusion 121*c* is locked against the locking protrusion 110*b* of the second body 100*b*.

The second contact group 200*b* as shown in FIG. 5A to FIG. 5E may be compliant with USB 2.0 standard. The second contact group 200*b* consists of generally L-shaped third contacts 210*b*, 220*b*, 230*b*, 240*b*, each formed of an electrically conductive metal plate. The third contacts 210*b*, 220*b*, 230*b*, 240*b* are held in the third body 100*c* and arrayed in this order at spaced intervals along the −Z direction. The third contact 210*b* is a Vbus contact. The third contacts 220*b*, 230*b* are Data−, Data+ contacts constituting a differential pair, and they are disposed adjacent to each other. The third contact 240*b* is a GND contact.

The third contact 210*b* has a contact portion 211*b*, a straight portion 212*b*, an inclined portion 213*b*, and a tail 214*b*. The third contact 220*b* has a contact portion 221*b*, a straight portion 222*b*, an inclined portion 223*b*, and a tail 224*b*. The third contact 230*b* has a contact portion 231*b*, a straight portion 232*b*, an inclined portion 233*b*, and a tail 234*b*. The third contact 240*b* has a contact portion 241*b*, a straight portion 242*b*, an inclined portion 243*b*, and a tail 244*b*.

The contact portions 211*b*, 221*b*, 231*b*, 241*b* are plates of generally V-shapes with apexes pointing in the X direction. The straight portions 212*b*, 222*b*, 232*b*, 242*b* are elongated plates continuous with the contact portions 211*b*, 221*b*, 231*b*, 241*b*, respectively, and they all extend in the Y direction. The inclined portions 213*b*, 223*b*, 233*b*, 243*b* are elongated plates continuous with the straight portions 212*b*, 222*b*, 232*b*, 242*b*, respectively, and they all extend obliquely in the Y and −Z directions. The inclined portion 213*b* has a larger length than the inclined portion 223*b*. The inclined portion 223*b* has a larger length than the inclined portion 233*b*. The inclined portion 233*b* has a larger length than the inclined portion 243*b*. The tail 214*b*, 224*b*, 234*b*, 244*b* are plates continuous with the inclined portion 213*b*, 223*b*, 233*b*, 243*b*, respectively, and they all extend in the −Z direction.

As shown in FIG. 4A, the inclined portions 213*b*, 223*b*, 233*b*, 243*b* are embedded (fixed) in the plate 130*c* of the third body 100*c* and arrayed in this order at spaced intervals along the −Z direction. The Y direction ends of the straight portions 212*b*, 222*b*, 232*b*, 242*b* are embedded in the block 110*c* of the third body 100*c* and arrayed in this order at spaced intervals along the −Z direction. As shown in FIG. 4B, the inclined portion 213*b* as embedded has an inclined face 213*b*1 in the Z direction exposed from the sloped face of the plate 130*c*. The portions other than the Y direction ends of the straight portions 212*b*, 222*b*, 232*b*, 242*b* project in the −Y direction out of the block 110*c*. The contact portions 211*b*, 221*b*, 231*b*, 241*b* are arrayed in this order at spaced intervals along the −Z direction. The tails 244*b*, 254*b*, 234*b*, 214*b* are arrayed in this order at spaced intervals along the Y direction. The tails 244*b*, 254*b*, 234*b*, 214*b* are connectable with respective second through-hole electrodes in the circuit board. The lengths of the inclined portions 213*b*, 223*b*, 233*b*, 243*b* are determined such that the distal ends of the tails 244*b*, 254*b*, 234*b*, 214*b* are flush with each other.

When the block 110*c* fits in the accommodation space α of the first body 100*a* and the plate 130*c* is held between the proximal portion 120*a* of the first body 100*a* and the second body 100*b*, the third contacts 210*b*, 220*b*, 230*b*, 240*b* are located in the region between the first straight portions 212*a*, 222*a*, 232*a*, 242*a*, 252*a* and the second straight portions 216*a*, 226*a*, 236*a*, 246*a*, 256*a* of the first contact group 200*a*, substantially in parallel to the first straight portions 212*a*, 222*a*, 232*a*, 242*a*, 252*a*. In this state, the portions other than the Y direction ends of the straight portions 212*b*, 222*b*, 232*b*, 242*b* and the contact portions 211*b*, 221*b*, 231*b*, 241*b* are received in the respective grooves 112*a* of the first body 100*a*, and the straight portions 212*b*, 222*b*, 232*b*, 242*b* are each held between the Z direction wall and the −Z direction wall of the associated groove 112*a* and elastically deformable in the −X direction (toward the first contact group). In this state, the straight portion 212*b* is disposed in a space between and on the X direction side of the first straight portions 212*a*, 222*a*; the straight portion 222*b* is disposed in a space between and on the X direction side of the first straight portions 222*a*, 232*a*; the straight portion 232*b* is disposed in a space between and on the X direction side of the first straight portions 232*a*, 242*a*; and the straight portion 242*b* is disposed in a space between and on the X direction side of the first straight portions 242*a*, 252*a*. The contact portions 211*b*, 221*b*, 231*b*, 241*b* are located in midair in the grooves 112*a* such that they are displaceable in the −X direction in accordance with the elastic deformation of the straight portions 212*b*, 222*b*, 232*b*, 242*b*. The inclined portions 213*b*, 223*b*, 233*b*, 243*b* are located between the first straight portions 212*a*, 222*a*, 232*a*, 242*a*, 252*a* and the second straight portions 216*a*, 226*a*, 236*a*, 246*a*, 256*a*, respectively. The tails 244*b*, 234*b*, 224*b*, 214*b* and the tails 217*a*, 227*a*, 237*a*, 247*a*, 257*a* are arranged in a staggered configuration.

Figure 5A:
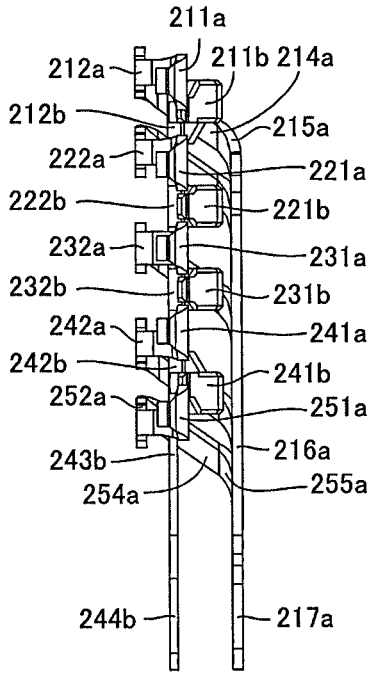
FIG. 5A is a front view of the first and second contact groups of the connector, showing the layout of contacts of the first and second contact groups.
Figure 5B:
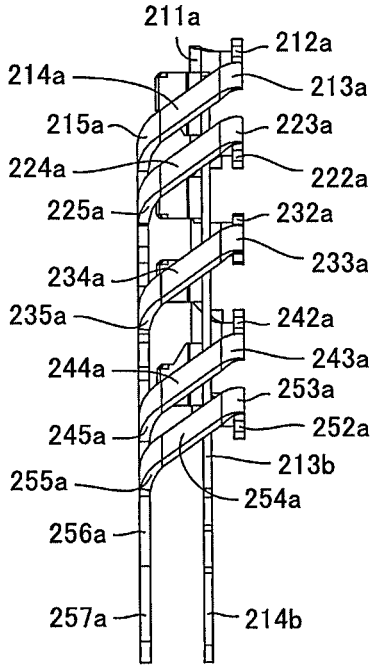
FIG. 5B is a back view of the first and second contact groups of the connector, showing the layout of the contacts of the first and second contact groups.
Figure 5C:
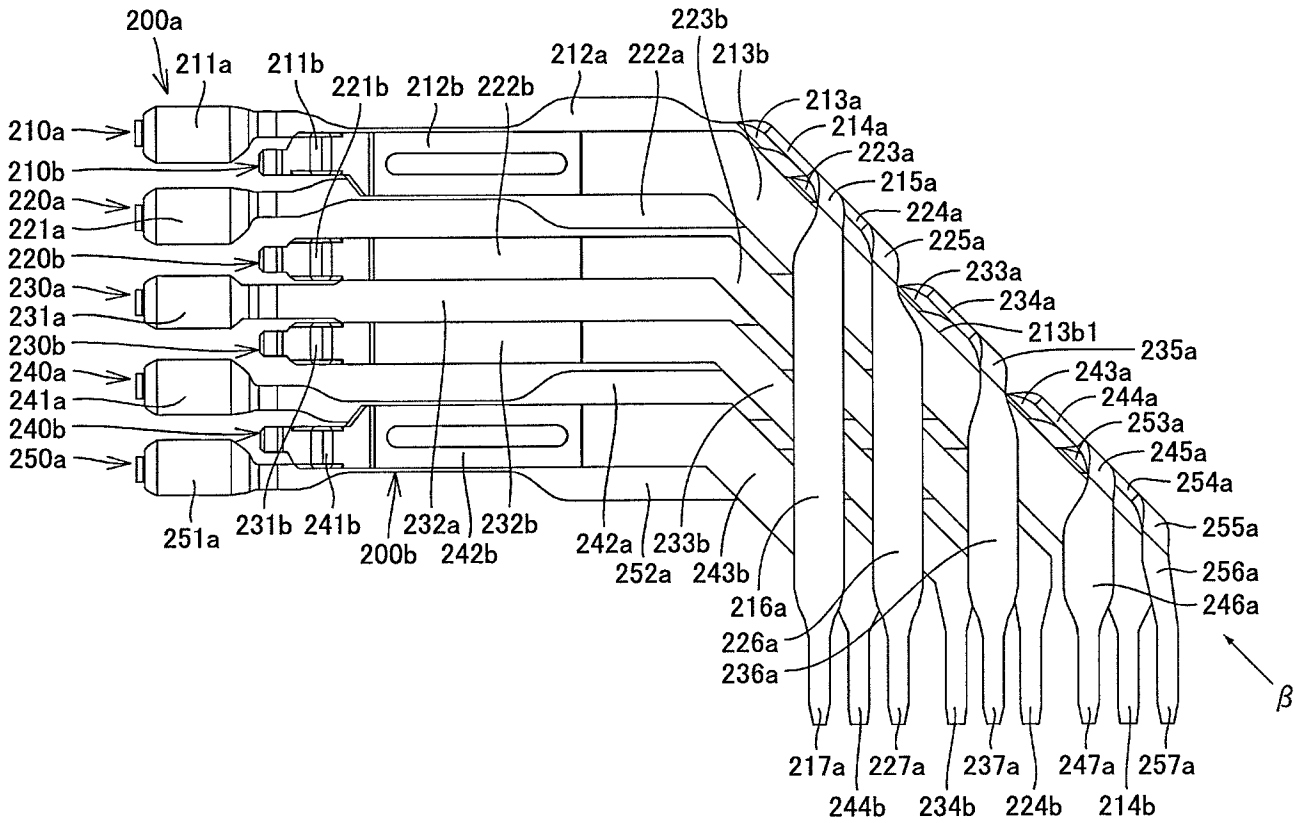
FIG. 5C is a right side view of the first and second contact groups of the connector, showing the layout of the contacts of the first and second contact groups.
Figure 5D:
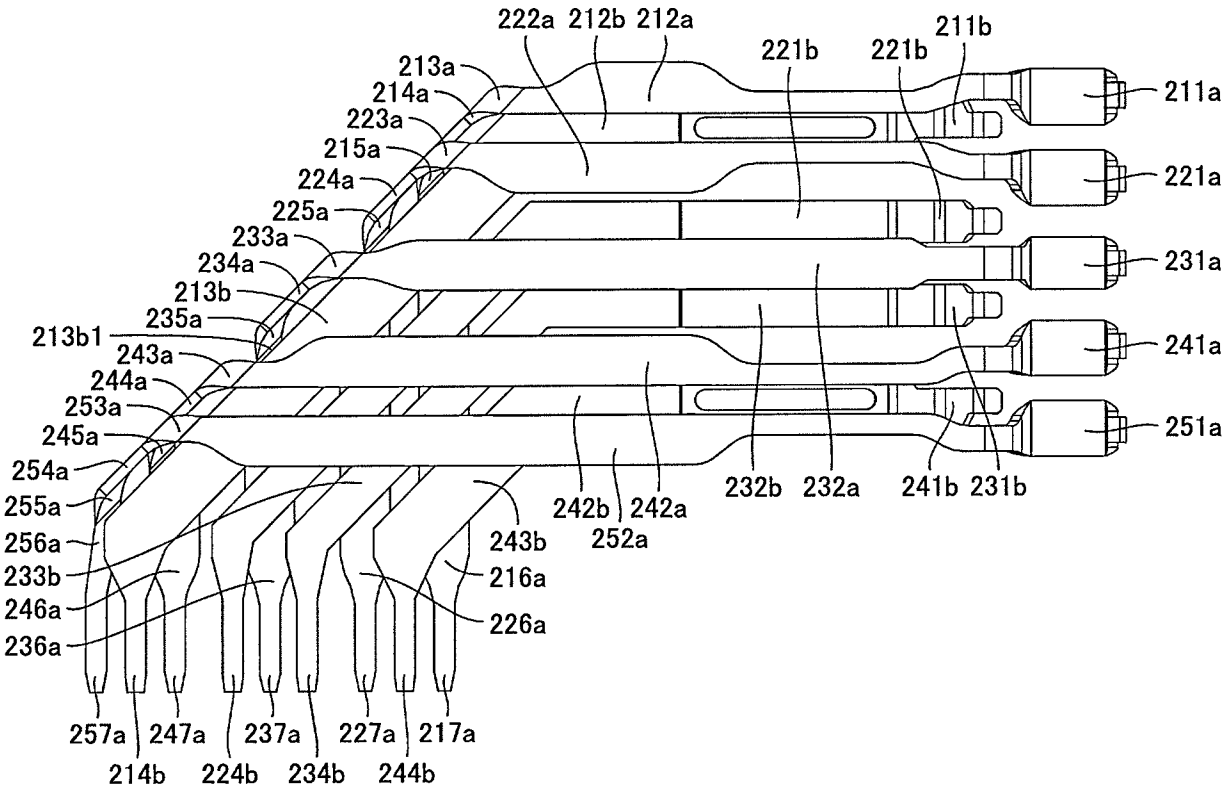
FIG. 5D is a left side view of the first and second contact groups of the connector, showing the layout of the contacts of the first and second contact groups.
Figure 5E:
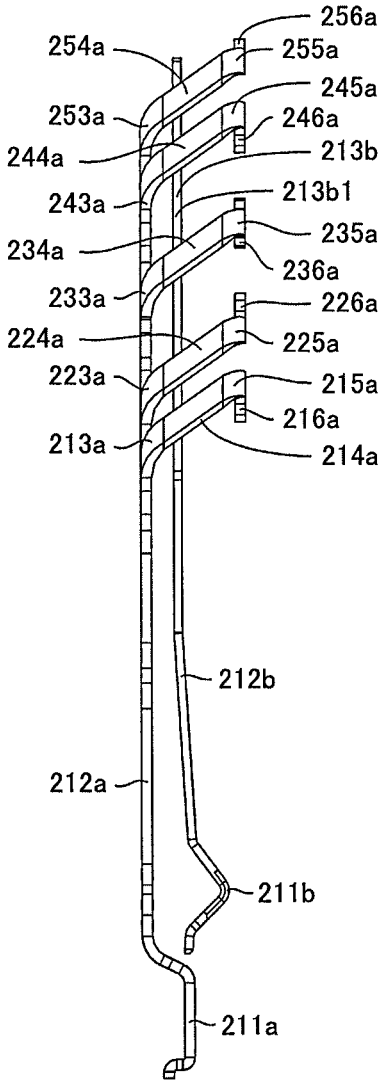
FIG. 5E is a plan view of the first and second contact groups of the connector, showing the layout of the contacts of the first and second contact groups.
Figure 5F:
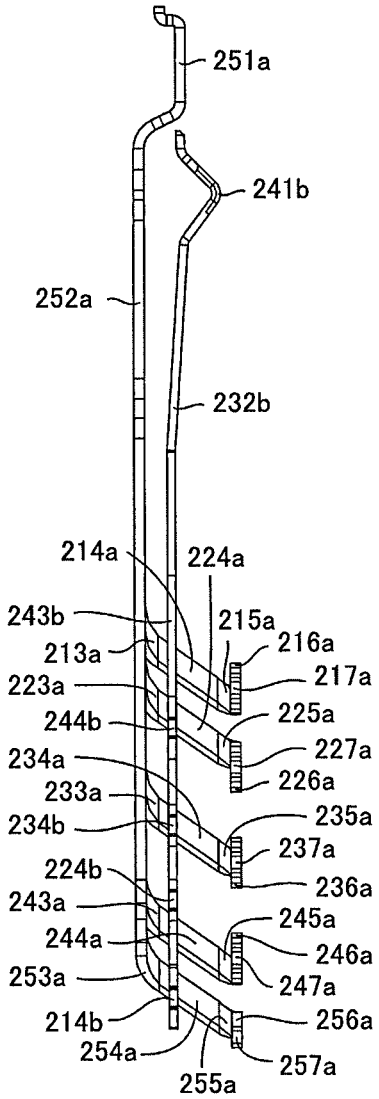
FIG. 5F is a bottom view of the first and second contact groups of the connector, showing the layout of the contacts of the first and second contact groups.
Figure 5G:
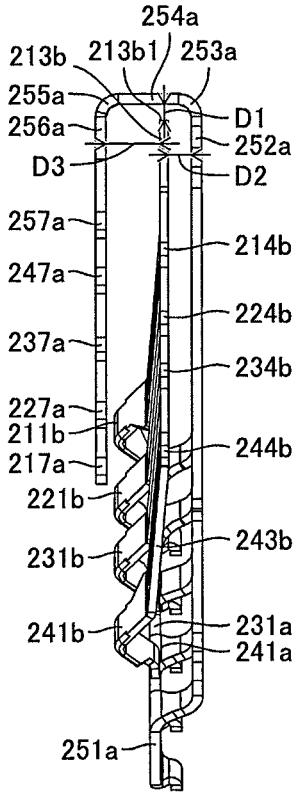
FIG. 5G is a perspective view of the first and second contact groups of the connector as viewed from the β direction in FIG. 5C, showing the layout of the contacts of the first and second contact groups.

The inclined portion 213*b* is located in the vicinity of the first bent portions 213*a*, 223*a*, 243*a*, 253*a*, the intermediate portion 214*a*, 224*a*, 244*a*, 254*a*, and the second bent portion 215*a*, 225*a*, 245*a*, 255*a*. The inclined face 213*b*1 of the inclined portion 213*b* of the third contact 210*b*, which is exposed from the sloped face of the plate 130*c*, is disposed substantially in parallel to the intermediate portion 214*a*, 224*a*, 234*a*, 244*a*, 254*a* of the first, second and fourth contacts 210*a*, 220*a*, 230*a*, 240*a*, 250*a* as shown in FIG. 5C, FIG. 5D and FIG. 5G. The first bent portions 213*a*, 223*a*, 243*a*, 253*a*, the intermediate portions 214*a*, 224*a*, 244*a*, 254*a*, and the second bent portions 215*a*, 225*a*, 245*a*, 255*a* as exposed from the first and second bodies 100*a*, 100*b* should have higher impedances than the other portions of the first and second contacts 210*a*, 220*a*, 240*a*, 250*a*. However, the above mentioned disposition of the inclined face 213*b*1 contributes to reduction in impedance of the first bent portions 213*a*, 223*a*, 243*a*, 253*a*, the intermediate portions 214*a*, 224*a*, 244*a*, 254*a*, and the second bent portions 215*a*, 225*a*, 245*a*, 255*a*. It should be appreciated that the first, second, third bodies 100*a*, 100*b*, 100*c* are not illustrated in FIG. 5G for convenience of description.

FIG. 5G indicates distances D1, D2, and D3, where D1 is the distance between the inclined portion 213*b* and the intermediate portions 214*a*, 224*a*, 234*a*, 244*a*, 254*a*; D2 is the distance between the inclined portion 213*b* and the first straight portions 212*a*, 222*a*, 232*a*, 242*a*, 252*a*; and D3 is the distance between the inclined portion 213*b* and the second straight portions 216*a*, 226*a*, 236*a*, 246*a*, 256*a*. The distances D1, D2, and D3 are adjusted in accordance with a difference between impedances I1 and I2, where I1 is each impedance of the first bent portions 213*a*, 223*a*, 243*a*, 253*a*, the intermediate portions 214*a*, 224*a*, 244*a*, 254*a*, and the second bent portion 215*a*, 225*a*, 245*a*, 255*a* of the first and second contacts 210*a*, 220*a*, 240*a*, 250*a*; I2 is a reference impedance required of the present connector, which may be 90Ω to 100Ω. For example, if the impedance I1 is higher than the reference impedance I2 in the case where D1 is approximately equal to D2 or to D3, the distances D1, D2, and D3 are adjusted such that D1 becomes smaller than D2 and than D3. If the impedance I1 is lower than the reference impedance I2 in the case where D1 is approximately equal to D2 or to D3, the distances D1, D2, and D3 are adjusted such that D1 becomes larger than D2 and than D3. FIG. 5G illustrates a case where D1 is smaller than D2 and than D3.

The shell 300 is formed of an electrically conductive metal plate. As shown in FIG. 1A to FIG. 1D, the shell 300 has a square tube 310, a pair of extended portions 320, a back cover 330, a pair of locking portions 340, a pair of first legs 350, and a second leg 360.

Figure 6A:
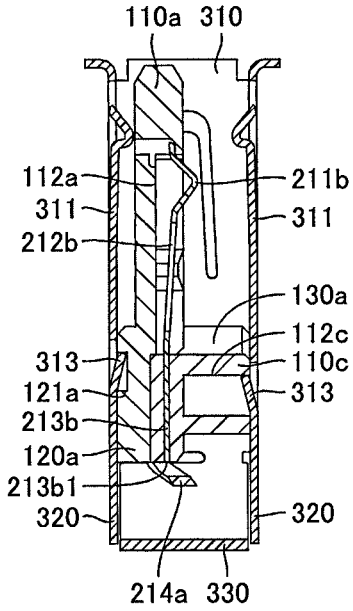
FIG. 6A is a sectional view taken along 6A-6A in FIG. 1B.
Figure 6B:
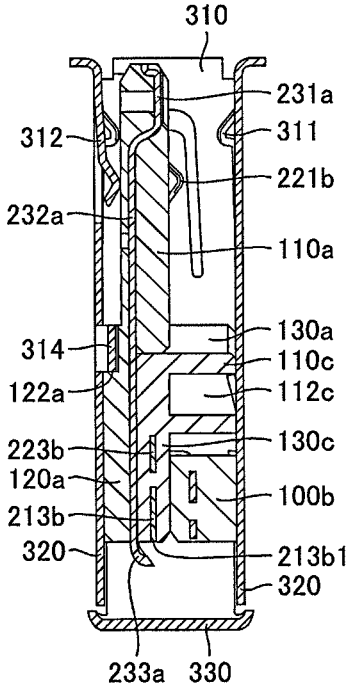
FIG. 6B is a sectional view taken along 6B-6B in FIG. 1B.
Figure 6C:
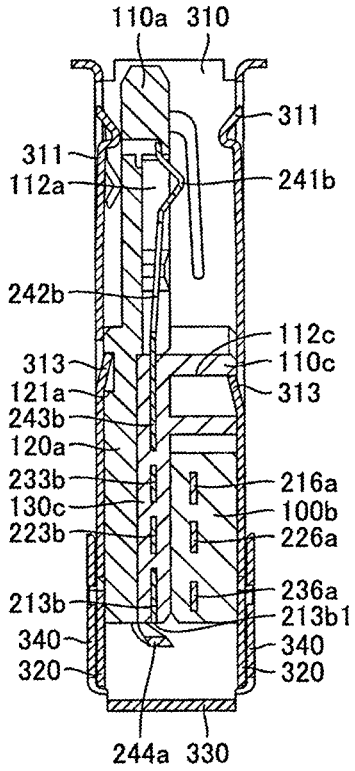
FIG. 6C is a sectional view taken along 6C-6C in FIG. 1B.

The square tube 310 consists of four plates, namely on the X, −X, Z, and −Z sides. As shown in FIG. 6A to FIG. 6C, the square tube 310 covers the distal portion 110*a*, the −Y direction end of the proximal portion 120*a*, and the pair of arms 130*a* the first body 100*a*, and the block 110*c* of the third body 100*c*. The X direction side plate of the square tube 310 is in contact with the block 110*c*, the −X direction side plate is in contact with the −Y direction end of the proximal portion 120*a*, and the Z direction side plate is in contact with the arm 130*a* on the Z direction side. The −Z direction side plate of the square tube 310 is received in the gap between this arm 130*a* and the second portion of the tongue 120*c* of the third body 100*c* as shown in FIG. 1C. The square tube 310, the distal portion 110*a*, the pair of arms 130*a*, and the block 110*c* define a slot for receiving a mating connector (e.g. USB 2.0 plug or USB 3.0 plug).

The −X direction side plate of the square tube 310 has a pair of first locking pieces 311, a second locking piece 312, a pair of third locking pieces 313, and a step-down 314. The X direction side plate of the square tube 310 has a pair of first locking pieces 311 and a pair of third locking pieces 313. The Z direction side plate of the square tube 310 has a first locking piece 311. The first locking pieces 311, five in all, are each formed by cutting a part of the −Y direction end of the plate, and they extend in the −Y direction. The second locking piece 312 is formed by cutting a portion between the locking pieces 311 at the −Y direction end of the −X direction side plate, and it extends in the Y direction. The first and second locking pieces 311, 312 are adapted to be locked in recesses of a mating connector received in the slot. The pairs of third locking pieces 313 are tabs formed by partially cutting the Y direction ends of the X and −X direction side plates and bending them in the −X and X directions, respectively. As shown in FIG. 6A, the step-down 314 is a projection inwardly projecting generally in U-shape, produced by bending in the X direction a portion between the third locking pieces 313 of the −Y direction end of the −X direction side plate. As shown in FIG. 6A, the third locking pieces 313 of the X direction side plate are locked in the locking hole 112*c* of the third body 100*c*. The third locking pieces 313 of the −X direction side plate are locked in the locking holes 121*a* of the first body 100*a*. As shown in FIG. 6B, the step-down 314 is locked in the locking recess 122*a* of the first body 100*a*.

The extended portions 320 are plates generally of right-triangle shape provided continuously with the Y direction ends of the X and −X direction side plates of the square tube 310. The space between the extended portions 320 accommodates the portion other than the −Y direction end of the proximal portion 120*a* of the first body 100*a*, the second body 100*b*, and the plate 130*c* of the third body 100*c*. The extended portion 320 on the −X direction side is in contact with the portion other than the −Y direction end of the proximal portion 120*a* of the first body 100*a*, and the extended portion 320 on the X direction side is in contact with the second body 100*b*. Between the hypotenuse sides of the extended portions 320 is formed an open portion. A protrusion 321 projects outward in the vicinity of the hypotenuse side of each extended portion 320.

The back cover 330 is a rectangular plate continuous with the Y direction end of the Z direction side plate of the square tube 310. The back cover 330 closes the open portion of the extended portions 320. In this state, the back cover 330 is located in the vicinity of and in spaced relation to the first bent portions 213*a*, 223*a*, 243*a*, 253*a*, the intermediate portions 214*a*, 224*a*, 244*a*, 254*a*, and the second bent portions 215*a*, 225*a*, 245*a*, 255*a* of the first, second and fourth contacts 210*a*, 220*a*, 230*a*, 240*a*, 250*a*. The back cover 330 extends substantially in parallel to the intermediate portions 214*a*, 224*a*, 234*a*, 244*a*, 254*a* of the first, second and fourth contacts 210*a*, 220*a*, 230*a*, 240*a*, 250*a*. This disposition of the back cover 330 contributes to reduction in impedance of the first bent portions 213*a*, 223*a*, 243*a*, 253*a*, the intermediate portions 214*a*, 224*a*, 244*a*, 254*a*, and the second bent portions 215*a*, 225*a*, 245*a*, 255*a*. That is, the back cover 330 functions as an impedance adjusting portion for adjusting the impedances of the first bent portions 213*a*, 223*a*, 243*a*, 253*a*, the intermediate portions 214*a*, 224*a*, 244*a*, 254*a*, and the second bent portions 215*a*, 225*a*, 245*a*, 255*a*.

The locking portions 340 are rectangular plates continuous with the X and −X direction ends of the back cover 330 and are bent at a substantially right angle to the back cover 330. The locking portions 340 each have a notch 341. The locking portions 340 are in contact with outer faces of the extended portions 320, and the protrusions 321 of the extended portions 320 are locked in the notches 341 of the locking portions 340. This locking mechanism maintains the state where the back cover 330 closes the open portion.

The first legs 350 are continuous with the extended portions 320 and extend in the −Z direction. The second leg 360 is continuous with the back cover 330 and extends in the −Z direction. The first and second legs 350, 360 are connectable with third through-hole electrodes in the circuit board. The shell 300 is grounded by connecting the first and second legs 350, 360 to the third through-hole electrodes of the circuit board.

The connector described above may be fabricated in the following steps. The first step is to prepare the first, second and fourth contacts 210*a*, 220*a*, 230*a*, 240*a*, 250*a*. The first, second and fourth contacts 210*a*, 220*a*, 230*a*, 240*a*, 250*a* are yet to be bent at the first bent portions 213*a*, 223*a*, 243*a*, 253*a* and the second bent portions 215*a*, 225*a*, 245*a*, 255 at (i.e. the first straight portions 212*a*, 222*a*, 232*a*, 242*a*, 252*a* and the second straight portions 216*a*, 226*a*, 236*a*, 246*a*, 256*a* extend in straight lines).

The first, second and fourth contacts 210*a*, 220*a*, 230*a*, 240*a*, 250*a* are inserted into dies, into which insulating resin is poured to form the first and second bodies 100*a*, 100*b* with the first, second and fourth contacts 210*a*, 220*a*, 230*a*, 240*a*, 250*a* inserted therein. Then, the contact portions 211*a*, 221*a*, 231*a*, 241*a*, 251*a* of the first, second and fourth contacts 210*a*, 220*a*, 230*a*, 240*a*, 250*a* are embedded in the first body 100*a* to be arrayed in this order at spaced intervals along the −Z direction, and the first straight portions 212*a*, 222*a*, 232*a*, 242*a*, 252*a* of the first, second and fourth contacts 210*a*, 220*a*, 230*a*, 240*a*, 250*a* are embedded in the first body 100*a* to be arrayed in this order at spaced intervals along the −Z direction. The contact portions 211*a*, 221*a*, 231*a*, 241*a*, 251*a* are exposed from the recesses 111*a* of the distal portion 110*a* of the first body 100*a*. The X direction faces of the first straight portion 212*a*, 222*a*, 232*a*, 242*a*, 252*a* are exposed from the X direction face of the proximal portion 120*a* of the first body 100*a*. On the other hand, the second straight portion 216*a*, 226*a*, 236*a*, 246*a*, 256*a* of the first, second and fourth contacts 210*a*, 220*a*, 230*a*, 240*a*, 250*a* are embedded in the second body 100*b* so as to extend through the second body 100*b*, particularly from the sloped face thereof to the −Z direction end face thereof. The tails 217*a*, 227*a*, 237*a*, 247*a*, 257*a* of the first, second and fourth contacts 210*a*, 220*a*, 230*a*, 240*a*, 250*a* are arranged in this order in a row. The first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a* of the first, second and fourth contacts 210*a*, 220*a*, 230*a*, 240*a*, 250*a* protrude out of between the first and second bodies 100*a*, 100*b*.

After insert molding the contacts in the first and second bodies 100*a*, 100*b*, the first and second contacts 210*a*, 220*a* are situated in such a manner as to substantially equalize the distances between the first straight portions 212*a*, 222*a*, between the first bent portions 213*a*, 223*a*, between the intermediate portions 214*a*, 224*a*, between the second bent portions 215*a*, 225*a*, and between the second straight portions 216*a*, 226*a*. Also, the first and second contacts 240*a*, 250*a* are situated in such a manner as to substantially equalize the distances between the first straight portions 242*a*, 252*a*, between the first bent portions 243*a*, 253*a*, between the intermediate portions 244*a*, 254*a*, between the second bent portions 245*a*, 255*a*, and between the second straight portions 246*a*, 256*a*.

In the meantime, the third contacts 210*b*, 220*b*, 230*b*, 240*b* are also prepared. The third contacts 210*b*, 220*b*, 230*b*, 240*b* are inserted into dies, into which insulating resin is poured to form the third body 100*c* with the third contacts 210*b*, 220*b*, 230*b*, 240*b* inserted therein. Then, the inclined portions 213*b*, 223*b*, 233*b*, 243*b* of the third contacts 210*b*, 220*b*, 230*b*, 240*b* are embedded in the third body 100*c* to be arrayed in this order at spaced intervals along the −Z direction. The Y direction ends of the straight portions 212*b*, 222*b*, 232*b*, 242*b* of the third contacts 210*b*, 220*b*, 230*b*, 240*b* are embedded in the third body 100*c* to be arrayed in this order at spaced intervals along the −Z direction, while the portions other than the Y direction ends of the straight portions 212*b*, 222*b*, 232*b*, 242*b* protrude in the −Y direction out of the third body 100*c*. The tails 244*b*, 254*b*, 234*b*, 214*b* of the third contacts 210*b*, 220*b*, 230*b*, 240*b* protrude in the −Z direction out of the third body 100*c* and are arrayed in this order at spaced intervals along the Y direction. The inclined face 213*b*1 of the inclined portion 213*b* of the third contact 210*b* is exposed from the sloped face of the third body 100*c* (sloped face of the plate 130*c*).

The next step is to insert the contact portions 211*b*, 221*b*, 231*b*, 241*b* of the third contacts 210*b*, 220*b*, 230*b*, 240*b* and the portions other than the Y direction ends of the straight portions 212*b*, 222*b*, 232*b*, 242*b* into the grooves 112*a* of the distal portion 110*a* of the first body 100*a*. Then, the straight portions 212*b*, 222*b*, 232*b*, 242*b* are each held between the Z direction wall and the −Z direction wall of the associated groove 112*a* of the distal portion 110*a*. As inserted, the straight portion 212*b* is located in the space between and on the X direction side of the first straight portions 212*a*, 222*a* of the first and second contacts 210*a*, 220*a*; the straight portion 222*b* is located in the space between and on the X direction side of the first straight portions 222*a*, 232*a* of the second and fourth contacts 220*a*, 230*a*; the straight portion 232*b* is located in the space between and on the X direction side of the first straight portions 232*a*, 242*a* of the fourth and first contacts 230*a*, 240*a*; and the straight portion 242*b* is located in the space between and on the X direction side of the first straight portions 242*a*, 252*a* of the first and second contacts 240*a*, 250*a*.

Simultaneously, the block 110*c* of the third body 100*c* is fittingly put into the accommodation space a, of the first body 100*a*, and the plate 130*c* of the third body 100*c* is brought into contact with the proximal portion 120*a* of the first body 100*a*. Then, the locking claws 111*c* of the block 110*c* are locked in the locking holes 131*a* of the arms 130*a* of the first body 100*a*. The fitting protrusion 132*c* of the plate 130*c* is fittingly put into the fitting hole 124*a* of the proximal portion 120*a*. The third body 100*c* is thus combined with the first body 100*a*.

The next step is to bend the first bent portions 213*a*, 223*a*, 233*a*, 243*a*, 253*a* of the first, second and fourth contacts 210*a*, 220*a*, 230*a*, 240*a*, 250*a* in the direction including components of X, Y, and −Z directions. Then, the intermediate portions 214*a*, 224*a*, 234*a*, 244*a*, 254*a* are oriented in the same direction (the direction including the components of X, Y, and −Z directions). After that, the second bent portions 215*a*, 225*a*, 235*a*, 245*a*, 255*a* are bent in the −Z direction. Then, the second straight portions 216*a*, 226*a*, 236*a*, 246*a*, 256*a* are oriented in the −Z direction, and the second body 100*b* is brought into contact with the third body 100*c*. As a result, the plate 130*c* of the third body 100*c* is held between the proximal portion 120*a* of the first body 100*a* and the second body 100*b*. At this point, the fitting protrusions 120*b* of the second body 100*b* fit into the fitting recesses 131*c* of the third body 100*c*, and the locking protrusion 121*c* of the tongue 120*c* of the third body 100*c* is locked against the locking protrusion 110*b* of the second body 100*b*. The tails 217*a*, 244*b*, 227*a*, 234*b*, 237*a*, 224*b*, 247*a*, 214*b*, 257*a* are arrayed along the Y direction in this order in a staggered manner. The first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a* are arranged on the Y direction side of the sloped faces of the first, second, and third bodies 100*a*, 100*b*, 100*c*. The inclined face 213*b*1 of the inclined portion 213*b* of the third contact 210*b*, which is exposed from the sloped face of the third body 100*c*, is disposed in the vicinity of and in spaced relation to the intermediate portions 214*a*, 224*a*, 234*a*, 244*a*, 254*a*. It should be appreciated that the distances D1, D2, and D3 are determined in such a manner as to substantially equalize the impedances of the first bent portions 213*a*, 223*a*, 243*a*, 253*a*, the intermediate portions 214*a*, 224*a*, 244*a*, 254*a*, and the second bent portions 215*a*, 225*a*, 245*a*, 255*a* of the first and second contacts 210*a*, 220*a*, 240*a*, 250*a* to the impedances of the remaining portions of the first and second contacts 210*a*, 220*a*, 240*a*, 250*a*. The first, second, and third bodies 100*a*, 100*b*, 100*c* are thus combined with one another.

The next step is to prepare the shell 300 by press-molding a meal plate. The shell 300 is in a state that the back cover 330 is oriented in flush with the Z direction side plate of the square tube 310, and the locking portions 340 are oriented in flush with the back cover 330. That is, the back cover 330 is not closing the open portion between the extended portions 320 at this point. In this state, the first, second, third bodies 100*a*, 100*b*, 100*c* are inserted into the shell 300 through the open portion. Then, the distal portion 110*a*, the −Y direction end of the proximal portion 120*a*, and the pair of arms 130*a* of the first body 100*a*, as well as the block 110*c* of the third body 100*c* are accommodated in the square tube 310 of the shell 300, and the other portion than the −Y direction end of the proximal portion 120*a* of the first body 100*a*, the second body 100*b*, and the plate 130*c* of the third body 100*c* are accommodated between the extended portions 320. At this point, the X direction side plate of the square tube 310 comes into contact with the block 110*c*; the −X direction side plate thereof comes into contact with the −Y direction end of the proximal portion 120*a*; and the Z direction side plate thereof comes into contact with the arm 130*a* on the Z direction side; the −Z direction side plate of the square tube 310 is inserted into the gap between the other arm 130*a* and the second portion of the tongue 120*c* of the third body 100*c*. Simultaneously, the extended portion 320 on the X direction side comes into contact with the second body 100*b*, and the extended portion 320 on the −X direction side comes into contact with the portion other than the −Y direction end of the proximal portion 120*a* of the first body 100*a*. The third locking pieces 313 of The X direction side plate are locked in the locking hole 112*c* of the third body 100*c*, the third locking pieces 313 of the −X direction side plate are locked in the locking holes 121*a* of the first body 100*a*, and the step-down 314 is locked in the locking recess 122*a* of the first body 100*a*.

The next step is to bend the boundary between the back cover 330 and the Z direction side plate of the square tube 310 in the −Z direction, thereby causing the back cover 330 to close the open portion. After that, the pair of locking portions 340 of the shell 300 is bent to come into contact with the extended portions 320 of the shell 300. Then, the protrusions 321 of the extended portions 320 are locked in the notches 341 of the locking portions 340.

The connector is thus assembled and now ready to be mounted on a circuit board. Specifically, the first and second legs 350, 360 of the shell 300 are inserted into and connected to the associated third-through hole electrodes in the circuit board. The tails 217*a*, 244*b*, 227*a*, 234*b*, 237*a*, 224*b*, 247*a*, 214*b*, 257*a* are also inserted into and connected to the associated first and second through-hole electrodes in the circuit board.

The components of the connector may operate in the following manner when connected to a mating connector, which may be a plug connector compliant with USB 2.0 or 3.0 standard (hereinafter referred to as "USB 2.0 plug" and "USB 3.0 plug"). When a USB 2.0 plug is inserted into the slot of the connector, the contacts of the USB 2.0 plug come into contact with the contact portions 211*b*, 221*b*, 231*b*, 241*b* of the third contacts 210*b*, 220*b*, 230*b*, 240*b*. Then, the straight portions 212*b*, 222*b*, 232*b*, 242*b* of the third contacts 210*b*, 220*b*, 230*b*, 240*b* elastically deform in the −X direction, and the contact portions 211*b*, 221*b*, 231*b*, 241*b* are displaced inside the grooves 112*a* in the −X direction. Then, the first and second locking pieces 311, 312 of the shell 300 are locked in recesses of the USB 2.0 plug. The USB 2.0 plug is thus connected to the connector.

When the USB 2.0 plug is pulled out of the slot of the connector, the first and second locking pieces 311, 312 are disengaged from the recesses of the USB 2.0 plug. The straight portions 212*b*, 222*b*, 232*b*, 242*b* move in the X direction back to their original positions, and the contact portions 211*b*, 221*b*, 231*b*, 241*b* are displaced inside the grooves 112*a* in the X direction.

When a USB 3.0 plug is inserted into the slot of the connector, the contacts of the USB 3.0 plug come into contact with the contact portions 211*a*, 221*a*, 231*a*, 241*a*, 251*a* of the first, second and fourth contacts 210*a*, 220*a*, 230*a*, 240*a*, 250*a*. Then, the first and second locking pieces 311, 312 of the shell 300 are locked in recesses of the USB 3.0 plug. The USB 3.0 plug is thus connected to the connector. The straight portions 212*b*, 222*b*, 232*b*, 242*b* of the third contacts 210*b*, 220*b*, 230*b*, 240*b* are pressed by the USB 3.0 plug and elastically deform in the −X direction, and the contact portions 211*b*, 221*b*, 231*b*, 241*b* are displaced inside the grooves 112*a* in the −X direction.

When the USB 3.0 plug is pulled out of the slot of the connector, the first and second locking pieces 311, 312 are disengaged from the recesses of the USB 3.0 plug. Then the pressing force on the straight portions 212*b*, 222*b*, 232*b*, 242*b* is released to allow them move in the X direction back to their original positions. The contact portions 211*b*, 221*b*, 231*b*, 241*b* are displaced in the grooves 112*a* in the X direction.

The above-described connector has many technical features. Particularly, the contact portions 211*a*, 221*b* of the first and second contacts 210*a*, 220*a* are arranged at spaced intervals along the −Z direction, and the first straight portions 212*a*, 222*a* extend in the Y direction. The first bent portions 213*a*, 223*a* are bent in the direction including components of X, Y, and −Z directions, the intermediate portions 214*a*, 224*a* extend in the same direction, and the second bent portions 215*a*, 225*a* are bent in the −Z direction. The second straight portions 216*a*, 226*a* extend in the −Z direction, and the tails 217*a*, 227*a* are arranged at spaced intervals along the Y direction. The first straight portion 222*a* has a larger length than the first straight portion 212*a*, and the second straight portion 226*a* has a smaller length than the second straight portion 216*a* by substantially the same amount as the difference in length between the first straight portion 222*a* and the first straight portion 212*a*. This configuration makes it possible to substantially equalize the overall lengths of the first and second contacts 210*a*, 220*a* and arrange them in parallel to each other. Moreover, the first and second contacts 210*a*, 220*a* are arranged in such a manner as to substantially equalize the distances between the first straight portions 212*a*, 222*a*, between the first bent portions 213*a*, 223*a*, between the intermediate portions 214*a*, 224*a*, between the second bent portions 215*a*, 225*a*, and between the second straight portions 216*a*, 226*a*. This disposition of the first and second contacts 210*a*, 220*a* can reduce the occurrence of skew and match the impedances between the two contacts. Similarly to the first and second contacts 210*a*, 220*a*, the first and second contacts 240*a*, 250*a* are also configured to reduce the occurrence of skew and match the impedances between the two contacts. In addition, the first and second contacts 210*a*, 220*a*, 240*a*, 250*a* are of such shapes as to extend substantially in parallel to one another through their lengths, so that the contacts can be manufactured by press-molding at a time. Consequently, it is possible to reduce the number of dies for manufacturing the first and second contacts 210*a*, 220*a*, 240*a*, 250*a* and therefore possible to reduce costs for the connector.

Further advantageously, the inclined portion 213*b* of the second contact 210*b* is disposed in the vicinity in the −Z direction of the first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a*. On the other hand, the back cover 330 of the shell 300 is disposed in the vicinity in the Z direction of the first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a*. This arrangement makes it possible to reduce the impedances of the portions exposed from the first and second bodies 100*a*, 100*b*, namely the first bent portions 213*a*, 223*a*, 243*a*, 253*a*, the intermediate portions 214*a*, 224*a*, 244*a*, 254*a*, and the second bent portions 215*a*, 225*a*, 245*a*, 255*a*. This results in matched impedances between the first and second contacts 210*a*, 220*a* and between the first and second contacts 240*a*, 250*a*.

Further, the first, second and fourth contacts 210*a*, 220*a*, 230*a*, 240*a*, 250*a* are contacts for high-speed digital signal transmission in compliance with the USB 3.0 standard, while the third contacts 210*b*, 220*b*, 230*b*, 240*b* are contacts for low-speed digital signal transmission in compliance with the USB 2.0 standard. The third contacts 210*b*, 220*b*, 230*b*, 240*b* are arranged in the region between the first straight portions 212*a*, 222*a*, 232*a*, 242*a*, 252*a* and the second straight portions 216*a*, 226*a*, 236*a*, 246*a*, 256*a* of the first, second and fourth contacts 210*a*, 220*a*, 230*a*, 240*a*, 250*a*. This arrangement of the contacts contributes to the reduction in cross talk between the first straight portions 212*a*, 222*a*, 232*a*, 242*a*, 252*a* and the second straight portions 216*a*, 226*a*, 236*a*, 246*a*, 256*a*. Also, the region to dispose the third contacts 210*b*, 220*b*, 230*b*, 240*b* is otherwise unused space of the connector, leading to reduction in dimension in the X and −X directions of the connector.

The present connector is also advantageous in assembly. In the first, second and fourth contacts 210*a*, 220*a*, 230*a*, 240*a*, 250*a*, the contact portions 211*a*, 221*a*, 231*a*, 241*a*, 251*a* and the first straight portions 212*a*, 222*a*, 232*a*, 242*a*, 252*a* are held in the first body 100*a*, and the second straight portions 216*a*, 226*a*, 236*a*, 246*a*, 256*a* are held in the second body 100*b*. In the third contacts 210*b*, 220*b*, 230*b*, 240*b*, the inclined portions 213*b*, 223*b*, 233*b*, 243*b* and the Y direction ends of the straight portions 212*b*, 222*b*, 232*b*, 242*b* are held in the third body 100*c*. After inserting the straight portions 212*b*, 222*b*, 232*b*, 242*b* into the grooves 112*a* of the first body 100*a* and combining the first and third bodies 100*a*, 100*b*, the first bent portions 213*a*, 223*a*, 243*a*, 253*a* and the second bent portions 215*a*, 225*a*, 245*a*, 255*a* of the first, second and fourth contacts 210*a*, 220*a*, 230*a*, 240*a*, 250*a* are bent, and thereby the third body 100*c* is held between the first body 100*a* and the second body 100*b*. As a result, the third contacts 210*b*, 220*b*, 230*b*, 240*b* can be easily disposed in the region between the first straight portions 212*a*, 222*a*, 232*a*, 242*a*, 252*a* and the second straight portions 216*a*, 226*a*, 236*a*, 246*a*, 256*a* of the first contact group 200*a*. It is thus advantageously easy to assemble the connector. Further, the first bent portions 213*a*, 223*a*, 243*a*, 253*a* and the second bent portions 215*a*, 225*a*, 245*a*, 255*a* are bent in the state where the contact portions 211*a*, 221*a*, 231*a*, 241*a*, 251*a* and the first straight portions 212*a*, 222*a*, 232*a*, 242*a*, 252*a* are held in the first body 100*a* and the second straight portions 216*a*, 226*a*, 236*a*, 246*a*, 256*a* are held in the second body 100*b*. The bending step of the first bent portions 213*a*, 223*a*, 243*a*, 253*a*, and the second bent portions 215*a*, 225*a*, 245*a*, 255*a* is less likely to cause variations in shape and/or disposition of the first, second and fourth contacts 210*a*, 220*a*, 230*a*, 240*a*, 250*a*.

The above described connector is not limited to the above-described embodiment, and it may be modified in design in any manner within the scope of Claims. Modification examples will be described in detail below.

The connector of the above embodiment includes the first and second contacts 210*a*, 220*a* having substantially the same overall length, the fourth contact 230*a*, and the first and second contacts 240*a*, 250*a* having substantially the same overall length. The connector of the invention at least requires first and second contacts having substantially the same overall length. In other words, either the first and second contacts 210*a*, 220*a* or the first and second contacts 240*a*, 250*a* may be omitted. The third contact can be omitted.

The contact portions 211*a*, 221*a* of the first and second contacts 210*a*, 220*a* of the above embodiment are embedded in the first body 100*a* at spaced intervals along the −Z direction. However, the contact portions of the first and second contacts of the invention may be modified as long as they are spaced along the −Z direction. For example, in the case where the first straight portions of the first and second contacts are press-fitted into grooves or holes of the first body as described below, the contact portions of the first and second contacts may be received in the grooves or holes of the first body to be arranged at spaced intervals along the −Z direction.

The first straight portions 212*a*, 222*a* of the first and second contacts 210*a*, 220*a* of the above embodiment extend in the Y direction and are embedded in the first body 100*a* at spaced intervals in the −Z direction. The first straight portions of the first and second contacts of the invention may be modified as long as they are continuous with the contact portions, extend in the Y direction, and the first straight portion of the second contact has a larger length than the first straight portion of the first contact.

The first bent portions 213*a*, 223*a* of the first and second contacts 210*a*, 220*a* of the above embodiment are bent in the direction including components of the X, Y, and −Z directions. However, the first bent portions of the first and second contacts of the invention may be modified as long as they are continuous with the first straight portions and bent in a direction including a component of the X direction orthogonal to the Y direction. For example, the first bent portions of the first and second contacts may be bent in the X direction or in a direction including components of the X, Y, and Z directions, the X, −Y, and −Z directions, or the X, −Y and Z directions.

The intermediate portions 214*a*, 224*a* of the first and second contacts 210*a*, 220*a* of the above embodiment are continuous with the first bent portions 213*a*, 223*a*, and extend straight in the direction including components of the X, Y, and −Z directions. However, the intermediate portions of the first and second contacts of the invention may be modified as long as they are continuous with the first and second bent portions and connect between the first and second bent portions. For example, the intermediate portions of the first and second contacts may be of arc shape generally extending in the X direction, or in a direction including components of the X, Y, and Z directions, the X, Y, and −Z directions, the X, −Y, and −Z directions, or the X, −Y, and Z directions. Alternatively, the intermediate portions of the first and second contacts may extend straight generally in the X direction or in a direction including components of the X, Y, and Z directions, the X, −Y, and −Z directions, or the X, −Y, and Z directions.

The second bent portions 215*a*, 225*a* of the first and second contacts 210*a*, 220*a* of the above embodiment are continuous with the intermediate portions 214*a*, 224*a*, respectively, and are bent in the −Z direction. However, the second bent portions of the first and second contacts of the invention may be modified as long as they are continuous with the intermediate portions and bent in a direction including a component of the −Z direction orthogonal to the Y direction and to the X direction. For example, the second bent portions of the first and second contacts may extend in a direction including components of the Y and −Z directions, the −Y and −Z directions, the X, Y, and −Z directions, the X, −Y, and −Z directions, the −X, Y, and −Z directions, or the −X, −Y, and −Z directions.

The first bent portions 212*a*, 222*a*, the intermediate portions 214*a*, 224*a*, and the second bent portions 215*a*, 225*a* of the above embodiment are exposed from the first and second bodies 100*a*, 100*b*. However, the first bent portions, the intermediate portions, and the second bent portions of the first and second contacts of the invention may be embedded or accommodated in a body or bodies. Alternatively, the first and second contacts may be exposed from a body or bodies only in the intermediate portions, or in the intermediate portions and the first bent portions, or in the intermediate portions and the second bent portions.

The second straight portions 216*a*, 226*a* of the first and second contacts 210*a*, 220*a* of the above embodiment are continuous with the second bent portions 215*a*, 225*a*, and they extend in the −Z direction. However, the second straight portions of the first and second contacts of the invention may be modified as long as they are continuous with the second bent portions and extend in a direction including a component of the −Z direction, and as long as the second straight portion of the second contact has a smaller length than the second straight portion of the first contact. Accordingly, the length of the second straight portion of the second contact need not be smaller than the length of the second straight portion of the first contact by substantially the same amount as the difference in length between the first straight portion of the second contact and the first straight portion of the first contact.

The tails 217*a*, 227*a* of the first and second contacts 210*a*, 220*a* of the above embodiment are plates continuous with the second straight portions 216*a*, 226*a*, respectively, and they are arranged in spaced intervals along the Y direction. However, the tails of the first and second contacts of the invention may be modified as long as they are continuous with the second straight portions and are spaced along the Y direction. For example, the tails may be bent in a substantially L shape for surface-mounting an electrode etc. on the circuit board.

The first bent portions of the first and second contacts may be replaced with first curved portions continuous with the first straight portions and curved in a direction including a component of the second direction orthogonal to the first direction. The second bent portions of the first and second contacts in accordance with the embodiment and the modification examples as described above may be replaced with second curved portions continuous with the intermediate portions and curved in a direction including a component of the third direction orthogonal to the first and second directions. In this case, the intermediate portions may be provided between the first and second curved portions, and the second straight portions may be continuous with the second curved portions. The first and second bent portions may be smoothly bent to form first and second curved portions. Modification examples described above with respect to the first and second contacts 210*a*, 220*a* are applicable to the first and second contacts 240*a*, 250*a*. The first and second contacts may constitute differential pairs as described above or may be used as contacts for single-ended signaling.

The fourth contact 230*a* of the above embodiment has the contact portion 231*a*, the first straight portion 232*a*, the first bent portion 233*a*, the intermediate portion 234*a*, the second bent portion 235*a*, the second straight portion 236*a*, and the tail 237*a*. However, the fourth contact of the invention may have any other configuration. More particularly, the contact portion, the first straight portion, the first bent portion, the intermediate portion, the second bent portion, the second straight portion, and the tail of the fourth contact may be modified in a similar manner to the modification examples described above with respect to the first bent portion, the intermediate portion, the second bent portion, the second straight portion, and the tail, respectively of the first and second contacts. The first and second bent portions of the fourth contact can be replaced with first and second curved portions in a similar manner as in the first and second contacts. The first and second bent portions may be smoothly bent to form first and second curved portions.

The third contacts 210*b*, 220*b*, 230*b*, 240*b* of the above embodiment are disposed in the region between the first straight portions 212*a*, 222*a*, 232*a*, 242*a*, 252*a* of the first contact group 200*a* and the second straight portions 216*a*, 226*a*, 236*a*, 246*a*, 256*a* of the first contact group 200*a*. However, the third contacts may be modified as long as they are held in the body and arranged in spaced intervals along the X or −X direction to extend substantially in parallel to the first straight portions of the first and second contacts. As the third contacts are arranged in spaced intervals along the X or −X direction to extend substantially in parallel to the first straight portions of the first and second contacts, the third contacts can function as ground contacts or pseudo ground contacts for the first and second contacts. The third contacts therefore contribute to matched impedances between the first contacts and the second contacts. The connector of the invention requires at least one third contact.

The third contacts of the above embodiment each include the contact portion, the straight portion, the inclined portion, and the tail. However, the third contact or contacts of the invention may be modified in shape. The straight portion of each third contact may or may not be elastically deformable. For example, the contact portion and the straight portion of the third contact may be held or embedded in the body in an undeformable manner.

The inclined portion 213*b* of the third contact 210*b* of the above embodiment is located in the vicinity on the −Z direction side of the first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a*. However, this may not be the case if the first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a* are modified to be disposed in the body as described above. In the case where the first and second contacts include the first and second curved portions in place of the first and second bent portions, the inclined portions may be located in the vicinity on the −Z direction side of the first curved portions, the intermediate portions, and the second curved portions as in the embodiment. Alternatively, the inclined portions may not be located in the vicinity on the −Z direction side of the first curved portions, the intermediate portions, and the second curved portions.

The distances D1, D2, and D3 of the above embodiment are adjusted in accordance with the difference between the impedance I1 (the impedance of the first bent portions 213*a*, 223*a*, 243*a*, 253*a*, the intermediate portions 214*a*, 224*a*, 244*a*, 254*a*, and the second bent portion 215*a*, 225*a*, 245*a*, 255*a* of the first and second contacts 210*a*, 220*a*, 240*a*, 250*a*) and the reference impedance I2 required of the present connector. However, the relationship among the distances D1, D2, and D3 may be determined otherwise. An alternative means to match the impedance of the first bent portions, the intermediate portion, and the second bent portions of the first and second contacts with the reference impedance is simply to dispose the inclined portions of the third contacts substantially in parallel to the intermediate portions of the first and second contacts. Another alternative means is to adjust the shape (for example, degree of bending) of the first bent portions 213*a*, 223*a*, 233*a*, 243*a*, 253*a*, the intermediate portions 214*a*, 224*a*, 234*a*, 244*a*, 254*a*, and the second bent portions 215*a*, 225*a*, 235*a*, 245*a*, 255*a*. A further alternative means is to adjust the thickness (dimension in the X and −X directions) of the inclined portion 213*b*. In the connector of the above embodiment, the inclined face 213*b*1 of the inclined portion 213*b* is exposed from the sloped face of the third body 100*c*. However, the inclined portion of the invention may be embedded in the body. In the case where the first and second contacts include the first and second curved portions in place of the first and second bent portions, the relationship among the distances D1, D2, and D3 may be set as in the embodiment or as described in this paragraph. The reference impedance I2 of the above embodiment is set to 90 to 100Ω, but it is not limited to this. For example, in the case where the first and second contacts are for single-ended signaling, the reference impedance may be set to 45Ω to 50Ω.

The body 100 of the above embodiment consists of the first, second, and third bodies 100*a*, 100*b*, 100*c*. However, the body of the invention may be any insulative body adapted to hold the first and second contacts. For example, the body may consist of a first body for holding the contact portions and the first straight portions of the first and second contacts and a second body for holding the second straight portions of the first and second contacts. In this case, the third contact or contacts may be omitted or may be held in the first body or the second body.

The first body 100*a* of the above embodiment holds the contact portions 211*a*, 221*a*, 231*a*, 241*a*, 251*a* and the first straight portions 212*a*, 222*a*, 232*a*, 242*a*, 252*a* of the first, second, and fourth contacts 210*a*, 220*a*, 230*a*, 240*a*, 250*a* in an embedded manner. However, the first body of the invention may be any insulative body adapted to hold the first straight portions of the first and second contacts. For example, the first straight portions of the first and second contacts may be press-fitted into grooves or holes formed in the first body.

The second body 100*b* of the above embodiment holds the second straight portions 216*a*, 226*a*, 236*a*, 246*a*, 256*a* of the first, second, and fourth contacts 210*a*, 220*a*, 230*a*, 240*a*, 250*a* in an embedded manner. However, the second body of the invention may be any insulative body adapted to hold the second straight portions of the first and second contacts. For example, the second straight portions of the first and second contacts may be press-fitted into grooves or holes formed in the second body.

The third body 100*c* of the above embodiment holds the inclined portions 213*b*, 223*b*, 233*b*, 243*b* of the third contacts 210*b*, 220*b*, 230*b*, 240*b* and the Y direction ends of the straight portions 212*b*, 222*b*, 232*b*, 242*b* in an embedded manner. However, the third body of the invention may be any insulative body adapted to hold the inclined portions of the third contacts. For example, the inclined portions of the third contacts may be press-fitted into grooves formed in the third body.

In the connector of the above embodiment, the block 110*c* of the third body 100*c* is fitted in the accommodation space a of the first body 100*a*, and the plate 130*c* is held between the proximal portion 120*a* of the first body 100*a* and the second body 100*b*. However, the third body may be of any configuration adapted to be disposed between the first and second bodies.

The connector of the above embodiment includes the shell 300. However, the shell 300 can be omitted. Alternatively, the shell of the invention may be any electrically conductive shell adapted to surround the body holding the first and second contacts or holding the first, second, third contacts. For example, the shell may be formed by casting some metal. Alternatively, the shell may be formed of insulating resin with electrically conductive metal deposited thereon.

In the connector of the above embodiment, the back cover 330 of the shell 300 is disposed in the vicinity on the Z direction side of the first bent portions 213*a*, 223*a*, 243*a*, 253*a*, the intermediate portions 214*a*, 224*a*, 244*a*, 254*a*, and the second bent portions 215*a*, 225*a*, 245*a*, 255*a* to function as the impedance adjusting portion. However, the impedance adjusting portion of the invention may be any part of the shell adapted to be disposed in the vicinity of the intermediate portions of the first and second contacts.

Figure 7:
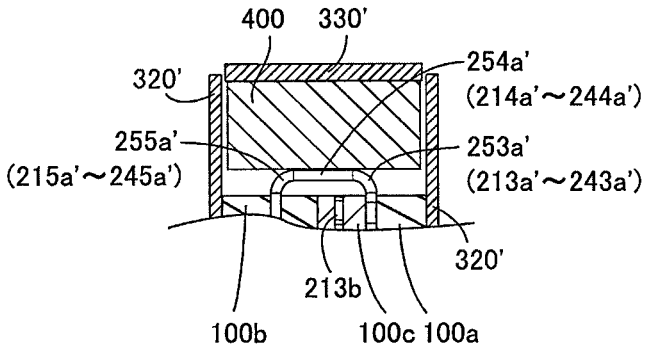
FIG. 7 is a schematic partial sectional view showing a modified connector.

The connector of the invention may further include a dielectric member provided between the intermediate portions of the first and second contact as exposed from the bodies and the shell. By way of example, FIG. 7 illustrates a dielectric member 400 made of the same insulating resin as the first, second, and third bodies 100*a*, 100*b*, 100*c*. The dielectric member 400 is disposed between intermediate portions 214*a*', 224*a*', 234*a*', 244*a*', 254*a*' of first, second and fourth contacts 210*a*', 220*a*', 230*a*', 240*a*', 250*a*' and a back cover 330'. FIG. 7 also illustrates first bent portions 213*a*', 223*a*', 233*a*', 243*a*', 253*a*' of the first, second and fourth contacts; second bent portions 215*a*', 225*a*', 235*a*', 245*a*', 255*a*' of the first, second and fourth contacts; an inclined portion 213*b* of the third contact; and an extended portion 320' of the shell.

It should be appreciated that the above-described preferred embodiment and modification examples are described by way of examples only. The material, shape, dimensions, number, arrangement, and other features of each constituent element of the connector may be modified as long as the same functions are provided. The connector of the above embodiment is a receptacle connector. However, the connector of the invention may be a plug connector, which may include tails or a circuit board for connection with a cable. The X and −X directions, the Y and −Y directions, and the Z and −Z directions are defined for the convenience of description, and they are not limited to the definition of the embodiment. The X and −X directions, the Y and −Y directions, and the Z and −Z directions may be any other directions of the connector. The first and second contacts may be press-molded as in the embodiment, but they may be casted or may be formed in any other means.

Reference Signs List

100: body
100*a*: first body
110*a*: distal portion
120*a*: proximal portion
130*a*: arm
100*b*: second body
100*c*: third body
110*c*: block
120*c*: tongue
130*c*: plate
200*a*: first contact group
210*a*: first contact
211*a*: contact portion
212*a*: first straight portion
213*a*: first bent portion

214*a*: intermediate portion
215*a*: second bent portion
216*a*: second straight portion
217*a*: tail
220*a*: second contact
221*a*: contact portion
222*a*: first straight portion
223*a*: first bent portion
224*a*: intermediate portion
225*a*: second bent portion
226*a*: second straight portion
227*a*: tail
230*a*: fourth contact
231*a*: contact portion
232*a*: first straight portion
233*a*: first bent portion
234*a*: intermediate portion
235*a*: second bent portion
236*a*: second straight portion
237*a*: tail
240*a*: first contact
241*a*: contact portion
242*a*: first straight portion
243*a*: first bent portion
244*a*: intermediate portion
245*a*: second bent portion
246*a*: second straight portion
247*a*: tail
250*a*: second contact
251*a*: contact portion
252*a*: first straight portion
253*a*: first bent portion
254*a*: intermediate portion
255*a*: second bent portion
256*a*: second straight portion
257*a*: tail
200*b*: second contact group
210*b* to 240*b*: third contact
211*b* to 241*b*: contact portion
212*b* to 242*b*: straight portion
213*b* to 243*b*: inclined portion
214*b* to 244*b*: tail
300: shell
310: square cylindrical portion
320: extending portion
330: back cover (impedance adjusting portion)
340: engaging portion
350: first leg
360: second leg

The invention claimed is:

1. A connector comprising:

a body of insulation; and first and second contacts being adapted to be held in the body and having substantially the same overall length, the first contact including:

a contact portion;

a first straight portion being continuous with the contact portion and extending in a first direction;

a first bent portion being continuous with the first straight portion and bent in a direction including a component of a second direction, the second direction being orthogonal to the first direction;

an intermediate portion being continuous with the first bent portion;

a second bent portion being continuous with the intermediate portion and bent in a direction including a component of a third direction, the third direction being orthogonal to the first and second directions;

a second straight portion being continuous with the second bent portion and extending in the direction including the component of the third direction; and a tail being continuous with the second straight portion, and the second contact includes:

a contact portion being spaced apart in the third direction from the contact portion of the first contact;

a first straight portion being continuous with the contact portion of the second contact, extending in the first direction, and having a larger length than the first straight portion of the first contact;

a first bent portion being continuous with the first straight portion of the second contact and bent in the same direction as the bending direction of the first bent portion of the first contact;

an intermediate portion being continuous with the first bent portion of the second contact;

a second bent portion being continuous with the intermediate portion of the second contact and bent in the same direction as the bending direction of the second bent portion of the first contact;

a second straight portion being continuous with the second bent portion of the second contact, extending along the second straight portion of the first contact, and having a smaller length than the second straight portion of the first contact; and a tail being continuous with the second straight portion of the second contact and being spaced apart in the first direction from the tail of the first contact.

2. The connector according to claim 1, wherein the first and second bent portions of the first and second contacts are smoothly bent.

3. The connector according to claim 1, wherein the length of the second straight portion of the second contact is smaller than the length of the second straight portion of the first contact by substantially the same amount as the difference in length between the first straight portion of the first contact and the first straight portion of the second contact.

4. The connector according to claim 1, further comprising a third contact held in the body, the third contact being disposed in spaced relation to the first straight portions of the first and second contacts in the second direction or a direction opposite to the second direction so as to extend substantially in parallel to the first straight portions of the first and second contacts.

5. The connector according to claim 4, wherein the third contact is disposed in a region defined between the first straight portions of the first and second contacts and the second straight portions of the first and second contacts.

6. The connector according to claim 5, the third contact comprising:

a contact portion;

a straight portion being continuous with the contact portion of the third contact, extending in the first direction, and spaced apart in the second direction from the first straight portions of the first and second contacts;

an inclined portion being continuous with the straight portion and obliquely inclined with respect to the straight portion, the inclined portions being disposed between the first straight portions of the first and second contacts and the second straight portions of the first and second contacts; and a tail being continuous with the inclined portion.

7. The connector according to claim 6, wherein the inclined portion of the third contact extends substantially in parallel to the intermediate portions of the first and second contacts.

8. The connector according to claim 1, wherein the body includes:

a first body for holding the contact portions and the first straight portions of the first and second contacts; and a second body for holding the second straight portions of the first and second contacts.

9. The connector according to claim 6, wherein the body includes:

a first body for holding the contact portions and the first straight portions of the first and second contacts;

a second body for holding the second straight portions of the first and second contacts; and a third body for holding the inclined portion of the third contact, the third body being disposed between the first and second bodies.

10. The connector according to claim 1, further comprising a shell with electrical conductivity for surrounding the body, wherein the intermediate portions of the first and second contacts are exposed from the body, and the shell includes an impedance adjusting portion to be disposed in the vicinity of the intermediate portions of the first and second contacts.

11. The connector according to claim 1, further comprising:

a shell with electrical conductivity for surrounding the body; and a dielectric member provided between the intermediate portions exposed from the bodies of the first and second contacts and the shell.

12. The connector according to claim 6, further comprising:

first and second differential pairs, each pair including the first and second contacts arranged in spaced relation in the third direction; and a fourth contact disposed between the first and second differential pairs, wherein the third contact comprises a plurality of the third contacts, the third contacts being arranged in said region in such a manner that the straight portions thereof are located between the first straight portions of the first and second contacts of the first differential pair, between the first straight portions of the first and second contacts of the second differential pair, between the first straight portion of the second contact of the first differential pair and the fourth contact, and between the first straight portion of the first contact of the second differential pair and the fourth contact.

13. The connector according to claim 12, wherein the contact portions and the first straight portions of the first and second contacts are fixed to the body, the inclined portions of the third contacts are fixed to the body, and the straight portions of the third contacts are elastically deformable toward the first straight portions of the first and second contacts.

14. The connector according to claim 1, wherein the first bent portions of the first and second contacts are bent in a direction including components of the first, second, and third directions, and the intermediate portions of the first and second contacts extend in the direction including components of the first, second, and third directions.

* * * * *